US008550578B2

(12) United States Patent
Brink

(10) Patent No.: US 8,550,578 B2
(45) Date of Patent: Oct. 8, 2013

(54) MEDICINE CABINET FRAME

(76) Inventor: Susan Martha Brink, Maricopa, AZ (US)

( * ) Notice: Subject to any disclaimer, the term of this patent is extended or adjusted under 35 U.S.C. 154(b) by 634 days.

(21) Appl. No.: 12/132,530

(22) Filed: Jun. 3, 2008

(65) Prior Publication Data

US 2009/0295260 A1 Dec. 3, 2009

(51) Int. Cl.
*E06B 1/00* (2006.01)

(52) U.S. Cl.
USPC ..... 312/321.5; 312/329; 312/245; 312/227

(58) Field of Classification Search
USPC ..... 312/326–329, 321.5, 292, 293.2, 245, 312/227, 7.2, 204, 348.4, 109, 224, 225, 312/226; 52/208; 40/798, 799
See application file for complete search history.

(56) References Cited

U.S. PATENT DOCUMENTS

| | | | | | |
|---|---|---|---|---|---|
| 153,283 | A | | 7/1874 | Shatto | |
| 1,941,126 | A | * | 12/1933 | Blackman | 312/329 |
| 2,608,458 | A | * | 8/1952 | Simpson | 312/329 |
| 2,882,114 | A | * | 4/1959 | Sease et al. | 312/279 |
| 3,039,217 | A | | 6/1962 | Stefanakis | |
| 3,109,685 | A | * | 11/1963 | Skorupa | 312/204 |
| 3,176,942 | A | | 4/1965 | Mitchell et al. | |
| 3,298,764 | A | * | 1/1967 | Goldfarb | 312/204 |
| 3,684,344 | A | | 8/1972 | Gilinger | |
| 3,737,646 | A | * | 6/1973 | Burrows | 362/140 |
| 3,918,782 | A | | 11/1975 | Allmand | |
| 3,930,702 | A | | 1/1976 | Pichowicz | |
| 4,239,310 | A | * | 12/1980 | Benjamin | 312/227 |
| 4,304,447 | A | | 12/1981 | Ellwood et al. | |
| 4,610,489 | A | | 9/1986 | Dibert, Jr. et al. | |
| 5,139,322 | A | | 8/1992 | Aisley | |
| 5,141,300 | A | | 8/1992 | Ciesla | |
| 5,189,760 | A | | 3/1993 | Aisley | |
| 5,255,971 | A | | 10/1993 | Aisley | |
| 5,267,786 | A | | 12/1993 | Aisley | |
| D370,568 | S | | 6/1996 | Wynne | |
| 5,564,808 | A | | 10/1996 | Gipson, Jr. et al. | |
| 5,624,170 | A | * | 4/1997 | Hasty | 312/329 |
| 5,791,752 | A | * | 8/1998 | Hartman | 312/204 |
| 6,012,789 | A | | 1/2000 | Lai | |
| 6,053,585 | A | * | 4/2000 | Osen | 312/204 |
| 6,092,884 | A | * | 7/2000 | Katz | 312/225 |
| 6,142,254 | A | | 11/2000 | Claybaugh et al. | |
| D436,480 | S | | 1/2001 | Winter et al. | |
| 6,244,718 | B1 | * | 6/2001 | Whitcomb | 359/872 |
| 6,375,332 | B1 | | 4/2002 | Whinney | |
| 6,449,917 | B1 | * | 9/2002 | Sullivan, III | 52/506.06 |
| 6,578,305 | B2 | * | 6/2003 | Lebrun | 40/800 |
| 6,715,245 | B2 | * | 4/2004 | Lewkowitz | 52/208 |
| 7,387,151 | B1 | * | 6/2008 | Payne | 160/371 |
| 2003/0042828 | A1 | * | 3/2003 | Bonin | 312/245 |
| 2004/0150301 | A1 | * | 8/2004 | Liberman | 312/245 |
| 2005/0093405 | A1 | * | 5/2005 | Greiner | 312/321.5 |
| 2005/0206279 | A1 | | 9/2005 | Lilly | |
| 2006/0119235 | A1 | * | 6/2006 | Aisley et al. | 312/242 |
| 2007/0013278 | A1 | * | 1/2007 | Herber | 312/227 |
| 2007/0114894 | A1 | * | 5/2007 | Milburn | 312/245 |

* cited by examiner

*Primary Examiner* — Darnell Jayne
*Assistant Examiner* — Daniel Rohrhoff
(74) *Attorney, Agent, or Firm* — Greg L. Martinez

(57) ABSTRACT

A fixture includes a medicine cabinet having a cabinet body and a door. The fixture includes a frame which includes a frame body having a recess sized and shaped to receive the door, and an overhang which extends along the upper portion of the door. The fixture can include a guide rail which is repeatably moveable between positions away from and extending over the lower portion of the door, and an organizer carried by the door.

29 Claims, 19 Drawing Sheets

MEDICINE CABINET FRAME

BACKGROUND OF THE INVENTION

1. Field of the Invention

This invention relates generally to wall mounted fixtures.

2. Description of the Related Art

Wall mounted fixtures, such as medicine cabinets are well-known in the art. These types of fixtures are often positioned in a bathroom and are used to store personal items, such as toiletries and medicine. A typical medicine cabinet generally includes a cabinet body with a mirrored door attached thereto. A number of shelves are positioned within the cabinet body for holding the personal items.

Most medicine cabinets come in standard sizes and designs and are already installed at a location. It would be useful to be able to change the medicine cabinet to better suit a user without having to remove it and replace it with another one. For example, some users may want to use the medicine cabinet as a decorative feature, such as a picture frame, instead of a mirror. Further, some users may want to change the look of the medicine cabinet to better match the look of the bathroom it is positioned in.

Most medicine cabinets are manufactured with predetermined shelf heights and shelf locations, so the end user is limited in the way in which they can organize the personal items stored therein. Hence, it would also be useful to allow the medicine cabinet to store more items in a manner that is organizable by the user.

BRIEF SUMMARY OF THE INVENTION

The present invention provides a fixture which includes a medicine cabinet with a cabinet body and door, and a frame having a frame body with a recess for receiving the door. The frame is carried by the door so that the frame moves in response to movement of the door. The frame includes an overhang which extends along the upper portion of the door.

In this embodiment, the fixture can include many other features. For example, the fixture can include a latch which is repeatably moveable between positions away from and extending over the lower portion of the door. The latch can include staggered support surfaces to accommodate the door and a display piece. In some embodiments, the frame includes a guide rail which is repeatably moveable between positions away from and extending over the lower portion of the door. The frame can include a door trim recess sized and shaped to receive door trim carried by the door.

In some embodiments, the frame includes a crown repeatably moveable between engaged and disengaged positions with the frame body. The frame can also include a shelf repeatably moveable between engaged and disengaged positions with the frame body. In this way, the crown and shelf can be removed and replaced with other crowns and shelves to provide the frame with a desired look.

The present invention also provides a fixture which includes a medicine cabinet with a cabinet body and a door having a mirror, wherein the fixture further includes a frame having a frame body with a recess for receiving the door. The frame includes a guide rail which is repeatably moveable between positions away from and extending over the lower portion of the door, and an overhang which extends along the upper portion of the door.

In this embodiment, the fixture can include many other features. For example, the guide rail can include a vertically extending slot portion and/or a horizontally extending slot portion. In some embodiments, the fixture includes a fastener which extends through the guide rail and frame body, wherein the fastener guides the movement of the guide rail.

The present invention provides a fixture which includes a medicine cabinet with a cabinet body and a door, and an organizer carried by the door. The organizer is positioned between the door and cabinet body when the door is closed. The fixture includes a frame carried by the door, wherein the frame includes a frame body having a recess for receiving the door and an overhang which extends along the upper portion of the door.

In this embodiment, the fixture can include many other features. For example, the organizer can be coupled with the frame. In some embodiments, the fixture includes a latch which is repeatably moveable between positions away from and extending over the lower portion of the door. In other embodiments, the fixture includes a guide rail which is repeatably moveable between positions away from and extending over the lower portion of the door.

These and other features, aspects, and advantages of the present invention will become better understood with reference to the following drawings and description.

DETAILED DESCRIPTION OF THE INVENTION

Figure 1A:
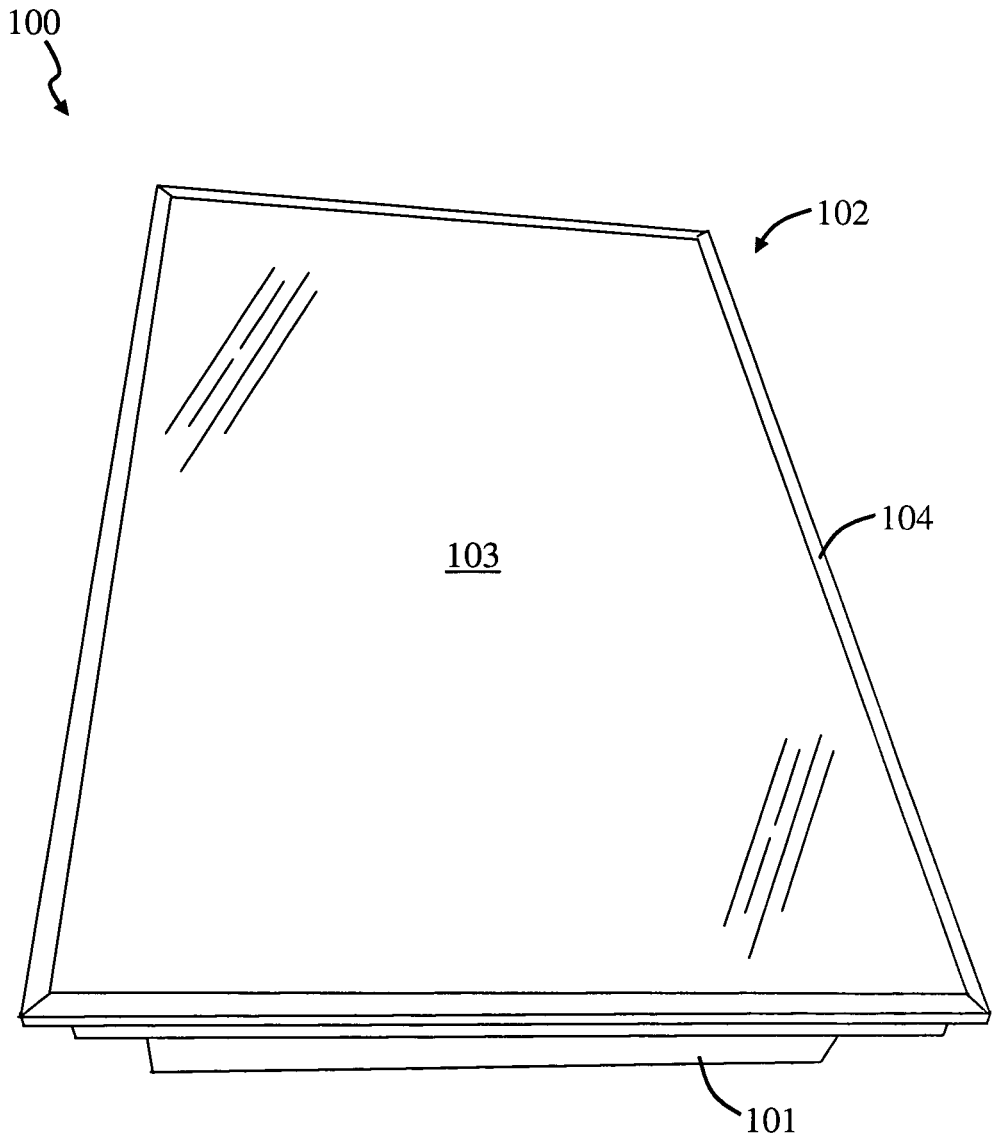
FIG. 1*a* is a perspective view of a medicine cabinet with a door in a closed position.
Figure 1B:
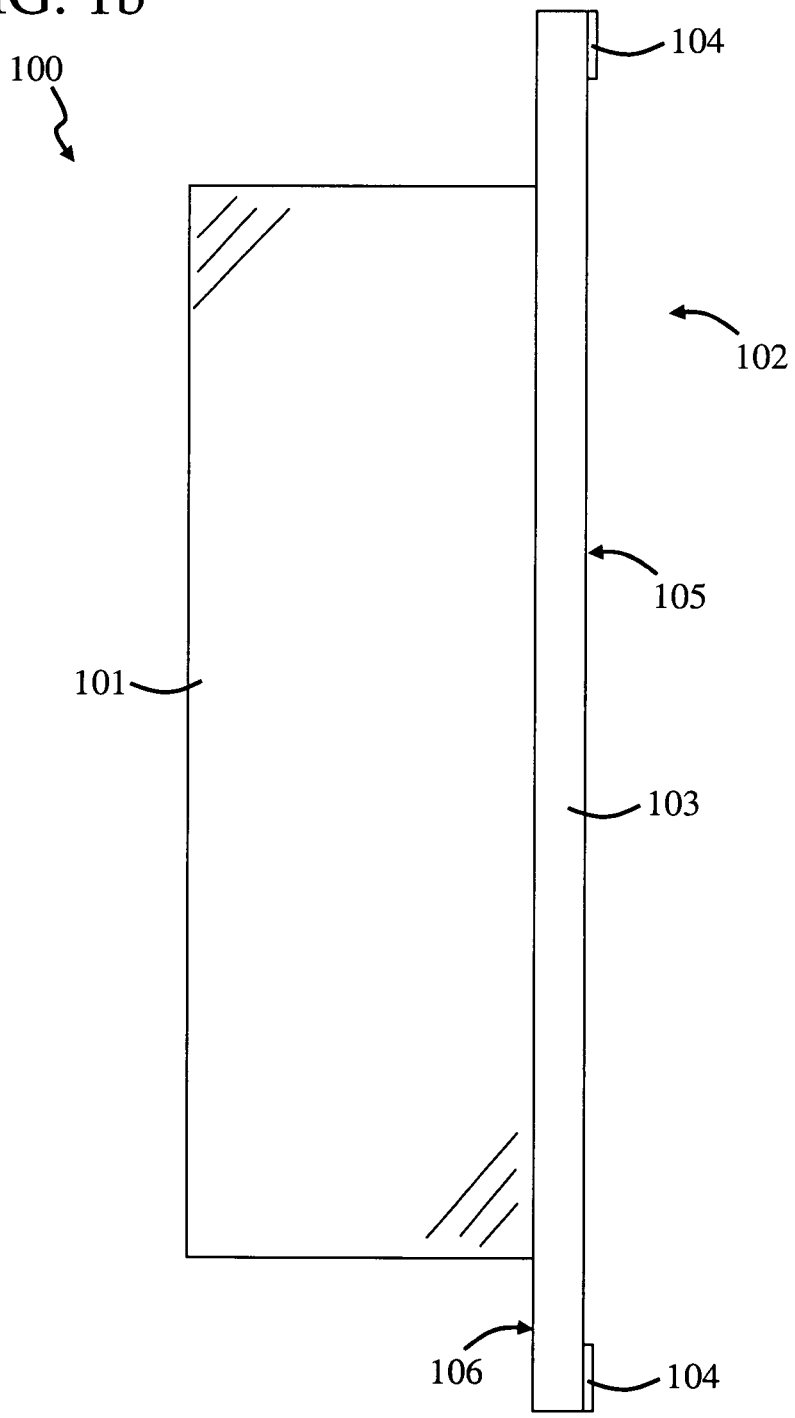
FIG. 1*b* is a side view of the medicine cabinet of FIG. 1*a*.
Figure 4A:
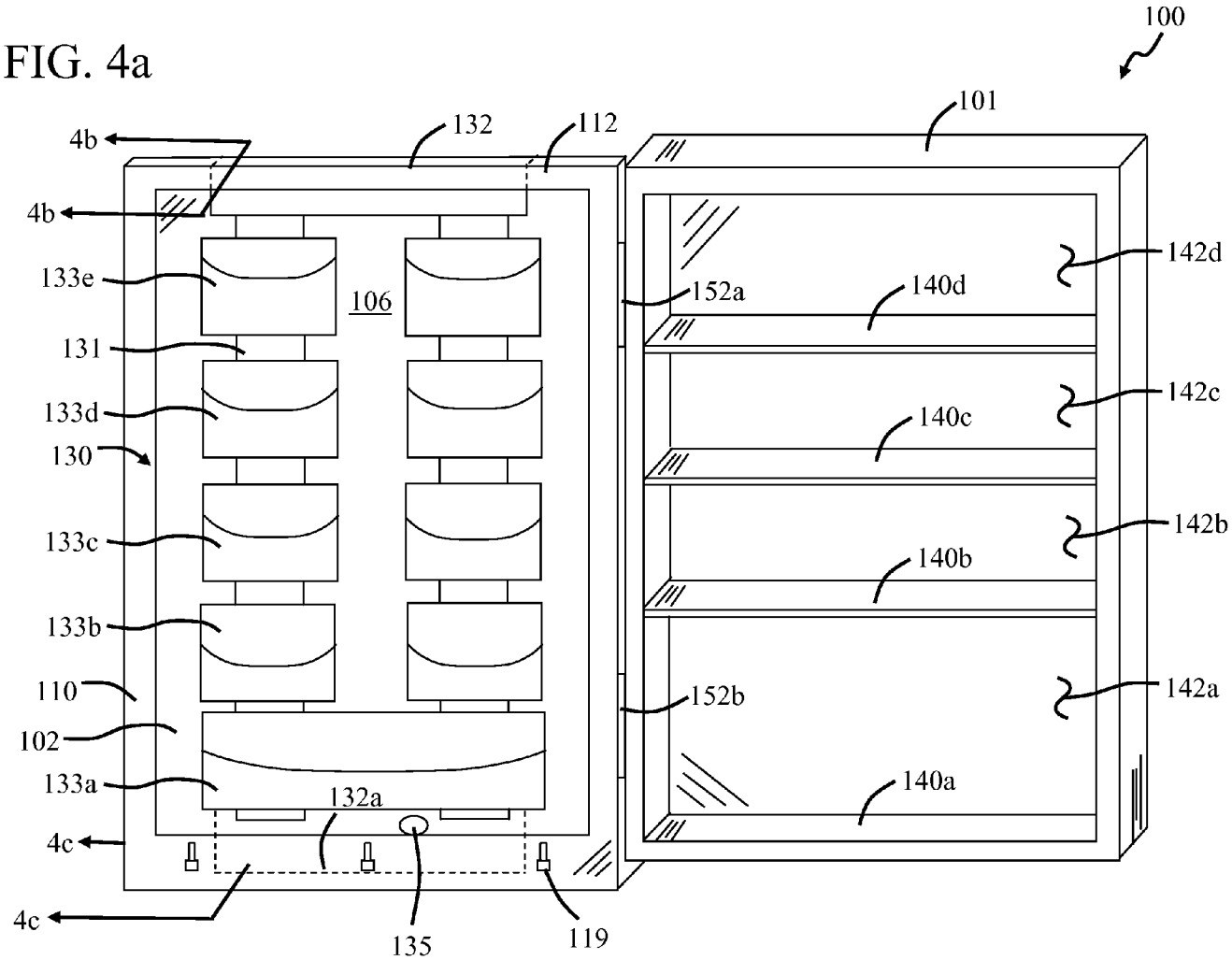
FIG. 4*a* is a perspective view of the medicine cabinet of FIG. 1*a* with the door in an open position, wherein the medicine cabinet carries an organizer, in accordance with the invention.

FIGS. 1*a* and 1*b* are perspective and side views, respectively, of a medicine cabinet 100. In this embodiment, medicine cabinet 100 includes a cabinet body 101 and a door 102, wherein door 102 is repeatably moveable between open and closed positions. In this embodiment, door 102 is coupled to cabinet body 101 with hinges 152*a* and 152*b*, as shown in FIG. 4*a*. Hinges 152*a* and 152*b* allow door 102 to move between the open and closed positions. Hinges 152*a* and 152*b* allow door 102 to rotate between the open and closed positions. In this way, door 102 is rotatably mounted to cabinet body 101. Door 102 includes a mirror 103 and door trim 104 extending around its outer periphery. It should be noted that door trim 104 is optional and is included in this embodiment for illustrative purposes. In other embodiments, the outer periphery of mirror 103 can include a smoothed or beveled surface. Mirror 103 is positioned adjacent to a front surface 105 of door 102. In this way, front surface 105 is a mirrored surface. Door 102 also includes a back surface 106 which faces away from front surface 105. More information regarding medicine cabinets can be found in U.S. Pat. Nos. D436,480, 5,139,322, 5,189,760, 5,255,971 and 5,267,786.

Figure 1C:
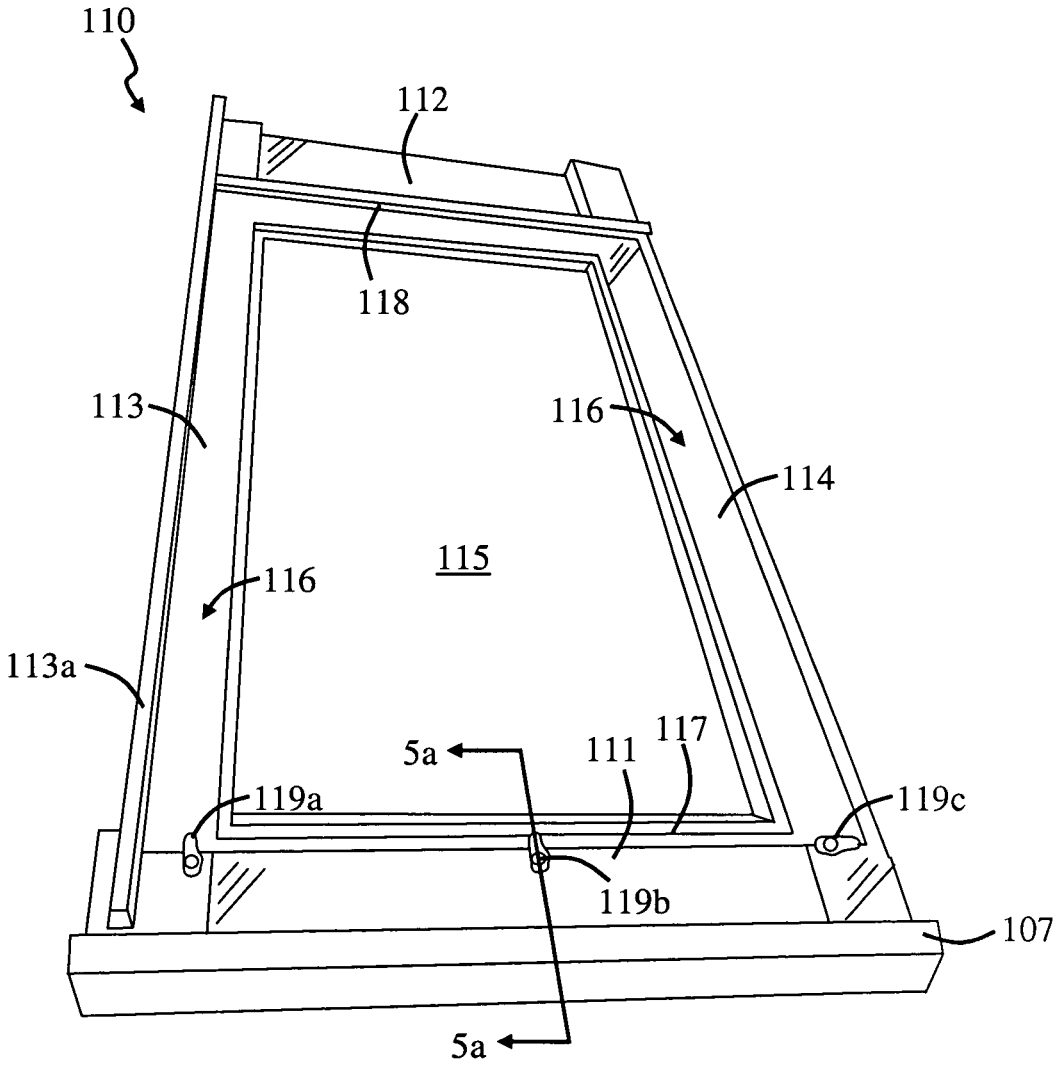
FIG. 1*c* is a rear perspective view of a frame, in accordance with the invention, which can be carried by the medicine cabinet of FIG. 1*a*.

FIG. 1*c* is a rear perspective view of a frame 110, in accordance with the invention. In this embodiment, frame 110 includes a frame body having upper and lower frame members 112 and 111, as well as vertical frame members 113 and 114. Frame 110 includes a vertical rail 113*a* extending outwardly from and at a substantially perpendicular angle with vertical frame member 113. Vertical rain 113*a* is useful to make medicine cabinet 100 look flush with a wall that medicine cabinet 100 is mounted to. In particular, vertical rain 113*a* is useful to hide cabinet body 101. Vertical frame members 113 and 114 are spaced apart from each other and extend between upper and lower frame members 112 and 111. A frame opening 115 is bounded by upper and lower frame members 112 and 111 and vertical frame members 113 and 114. In this way, frame 110 includes a frame opening bounded by frame members.

In this embodiment, frame 110 includes a recess 116 which extends through the frame body. In particular, recess 116 extends through upper and lower frame members 112 and 111 and vertical frame members 113 and 114. Recess 116 includes upper and lower recesses 118 and 117 which extend through upper and lower frame members 112 and 111, respectively. Recess 116 operates as a rabbet so that door 102 can be fitted therein.

In this embodiment, latches 119*a*, 119*b* and 119*c* are coupled with lower frame member 111. Latches 119*a*, 119*b* and 119*c* are repeatably moveable between latched and unlatched positions. In FIG. 1*c*, latches 119*a* and 119*b* are in the latched position and latch 119*c* is in the unlatched position.

Figure 2A:
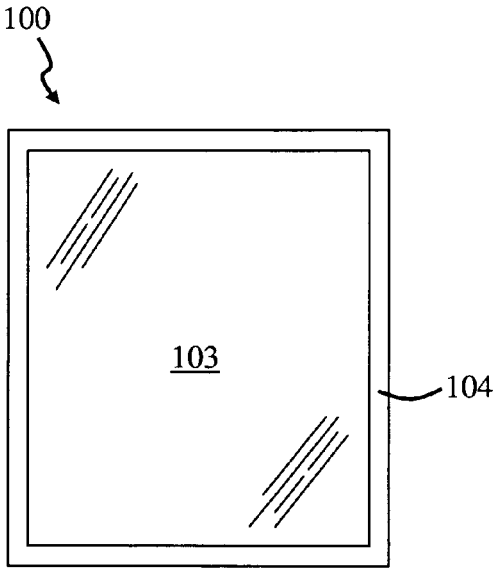
FIGS. 2*a* and 2*b* are front views of the medicine cabinet of FIG. 1*a* and the frame of FIG. 1*c*, respectively.
Figure 2B:
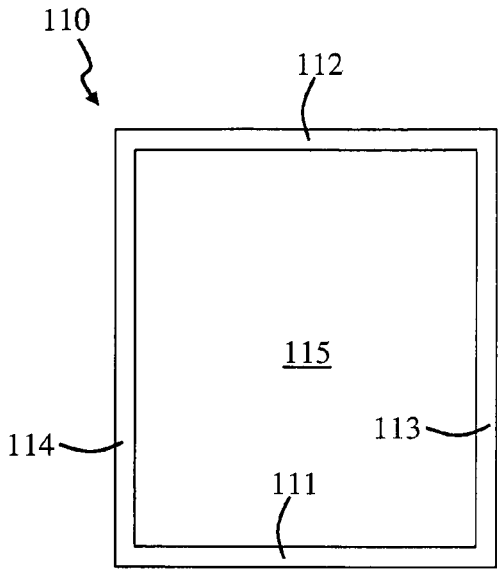
Figure 2C:
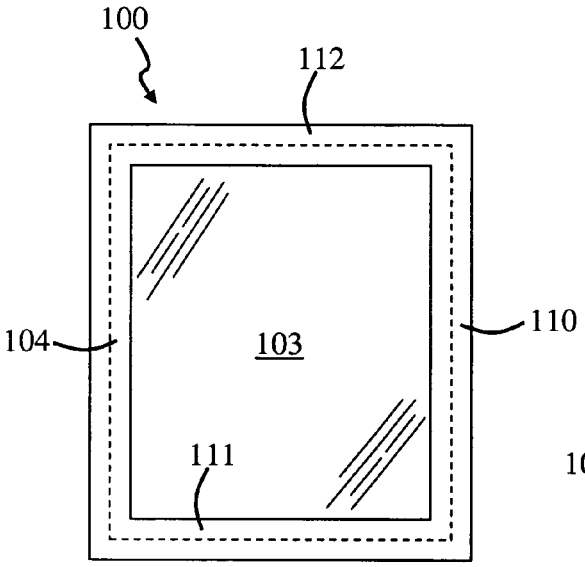
FIG. 2*c* is a front view of the frame of FIG. 1*c* being carried by the medicine cabinet of FIG. 1*a*, in accordance with the invention.

FIGS. 2*a* and 2*b* are front views of medicine cabinet 100 and frame 110, respectively. In accordance with the invention, frame 110 is carried by medicine cabinet 100, as shown in FIG. 2*c*. Frame 110 can be carried by medicine cabinet 100 in many different ways, such as by using an adhesive to adhesively couple them together. In this embodiment, frame 110 is carried by medicine cabinet 100 by extending door 102 through recess 116. In particular, door 102 is extended through upper recess 118 so it engages upper frame member 112 and door 102 is extended through lower recess 117 so it engages lower frame member 111.

Latches 119*a*, 119*b* and 119*c* are in the unlatched position so that recess 116 can receive door 102. Latches 119*a*, 119*b* and 119*c* are moved to the latched position to engage back surface 106 of door 102 and hold frame 110 thereto. Frame 110 is carried by door 102 so that frame 110 moves in response to movement of door 102. For example, frame 110 moves in response to the movement of door 102 between its open and closed positions.

Figure 2D:
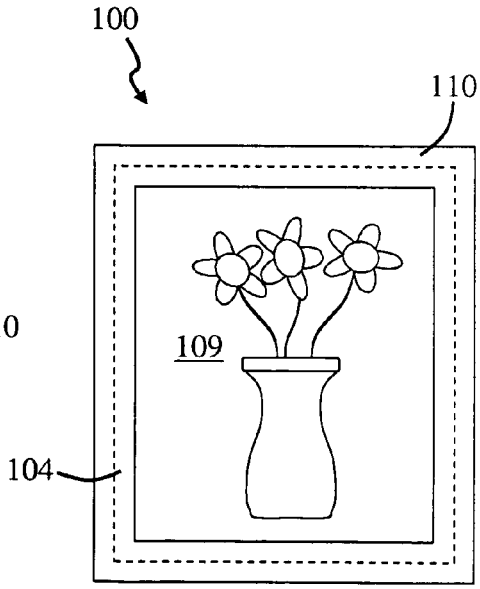
FIG. 2*d* is a front view of a display piece and the frame of FIG. 1*c* being carried by the medicine cabinet of FIG. 1*a*, in accordance with the invention.

In some embodiments, frame 110 can be used to hold a display piece to medicine cabinet 100. For example, in FIG. 2*d*, frame 110 holds a display piece 109 to front surface 105 of door 102. In particular, frame 110 holds display piece 109 to mirror 103 so that mirror 103 is covered. Display piece 109 can be of many different types, such as a picture and drawing board. However, in this embodiment, display piece 109 is shown as being a picture for illustrative purposes. The picture can be of many different types, such as a painting.

Further, the drawing board can be of many different types, such as a chalkboard and marker board. A drawing board is capable of displaying erasable indicia. In general, chalk is used to draw on a chalkboard and a marker is used to draw on a marker board. Examples of marker boards can be found in U.S. Pat. Nos. D507,812, D410,250 and 5,176,522 and examples of chalkboards can be found in U.S. Pat. Nos. D413,146 and 4,008,522. It should be noted that display piece 109 can cover all or a portion of door 102. For example, in some embodiments, display piece 109 extends partially upwardly along mirror 103 so that the upper portion of mirror 103 can be seen through frame opening 115, and the lower portion of mirror 103 cannot be seen through frame opening 115.

Figure 3A:
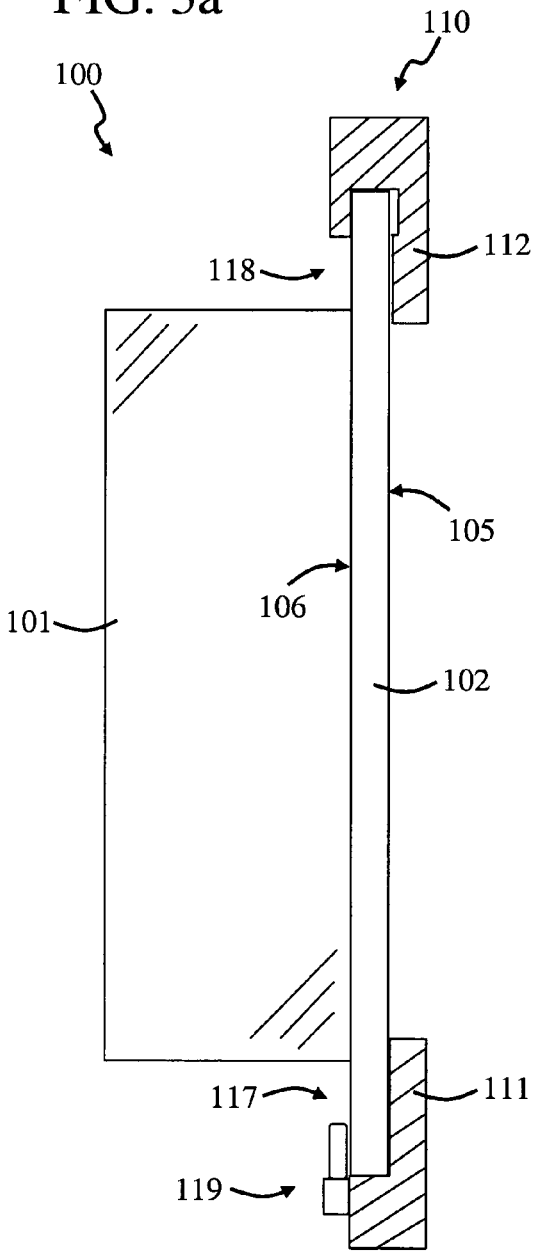
FIG. 3*a* is a side view of the frame of FIG. 1*c* being carried by a door of the medicine cabinet of FIG. 1*a*.

FIG. 3*a* is a side view of frame 110 being carried by door 102, in accordance with the invention. An upper portion of door 102 extends through upper recess 118 and a lower portion of door 102 extends through lower recess 117. In this embodiment, upper frame member 112 engages front and back surfaces 105 and 106 of door 102. Further, lower frame member 111 engages front surface 105 of door 102 and a latch 119 engages back surface 106 of door 102. In this way, frame 110 is carrier by door 102. It should be noted that latch 119 is the same as latches 119*a*, 119*b* and 119*c*.

Figure 3B:
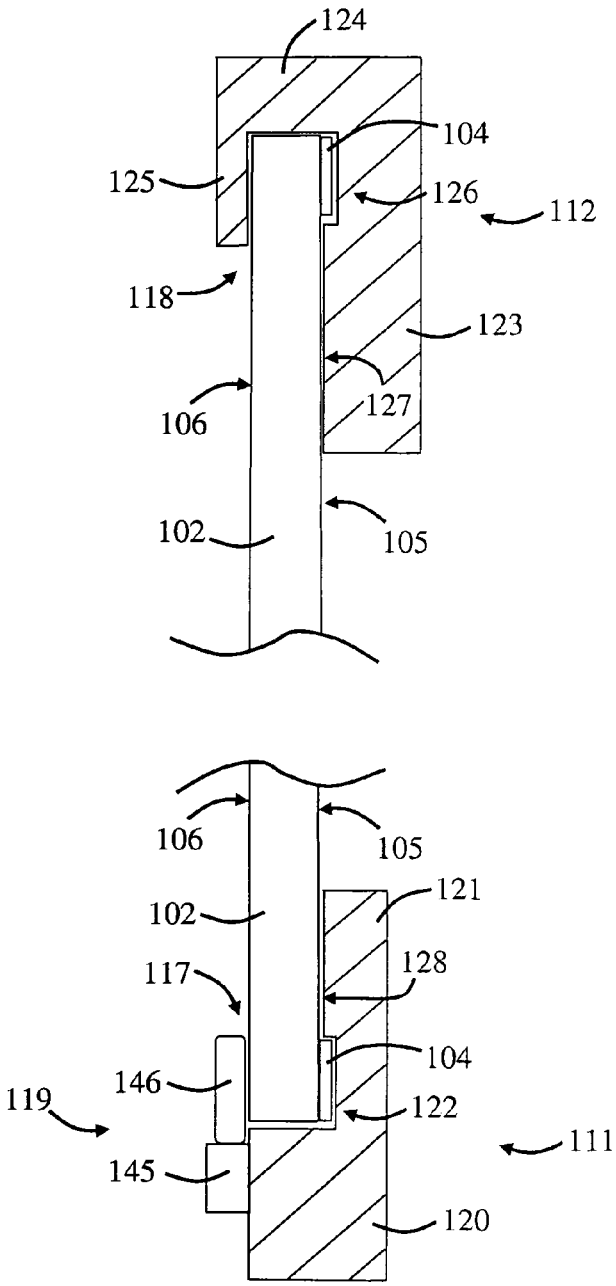
FIG. 3*b* is a close-up side view of the frame of FIG. 1*c* being carried by the door of the medicine cabinet of FIG. 1*a*.

FIG. 3*b* is a close-up side view of frame 110 being carried by door 102, in accordance with the invention. In this embodiment, upper frame member 112 includes an upper frame member body 124 with a downwardly extending portion 123 and upper frame member overhang 125 extending outwardly therefrom. Upper frame member overhang 125 engages back surface 106 of door 102 and downwardly extending portion 123 engages front surface 105. Upper recess 118 is bounded by upper frame member body 124, as well as downwardly extending portion 123 and upper frame member overhang 125.

In this embodiment, upper frame member 112 includes an upper door trim recess 126 which extends through downwardly extending portion 123, wherein recess 126 is sized and shaped to receive the portion of door trim 104 which faces upper frame member 112. In this way, upper frame member 112 is flush with door 102. It should be noted that an engagement surface 127 of downwardly extending portion 123 can be tapered towards door 102 so that it is flush with front surface 105 and mirror 103.

In this embodiment, lower frame member 111 includes an upwardly extending portion 121 and a lower frame member body 120, wherein latch 119 is coupled with lower frame member body 120. Latch 119 includes a latch body 145 and latch arm 146, which will be discussed in more detail with FIG. 5*a*. Upwardly extending portion 121 engages front surface 105 and mirror 103 and latch 119 engages back surface 106 of door 102. Lower recess 117 is bounded by lower frame member body 120 and upwardly extending portion 121.

In this embodiment, lower frame member 111 includes a lower door trim recess 122 which extends through upwardly extending portion 121, wherein recess 122 is sized and shaped to receive the portion of door trim 104 which faces lower frame member 111. In this way, lower frame member 111 is flush with door 102. It should be noted that an engagement surface 128 of upwardly extending portion 121 can be tapered towards door 102 so that it is flush with front surface 105 and mirror 103.

Figure 3C:
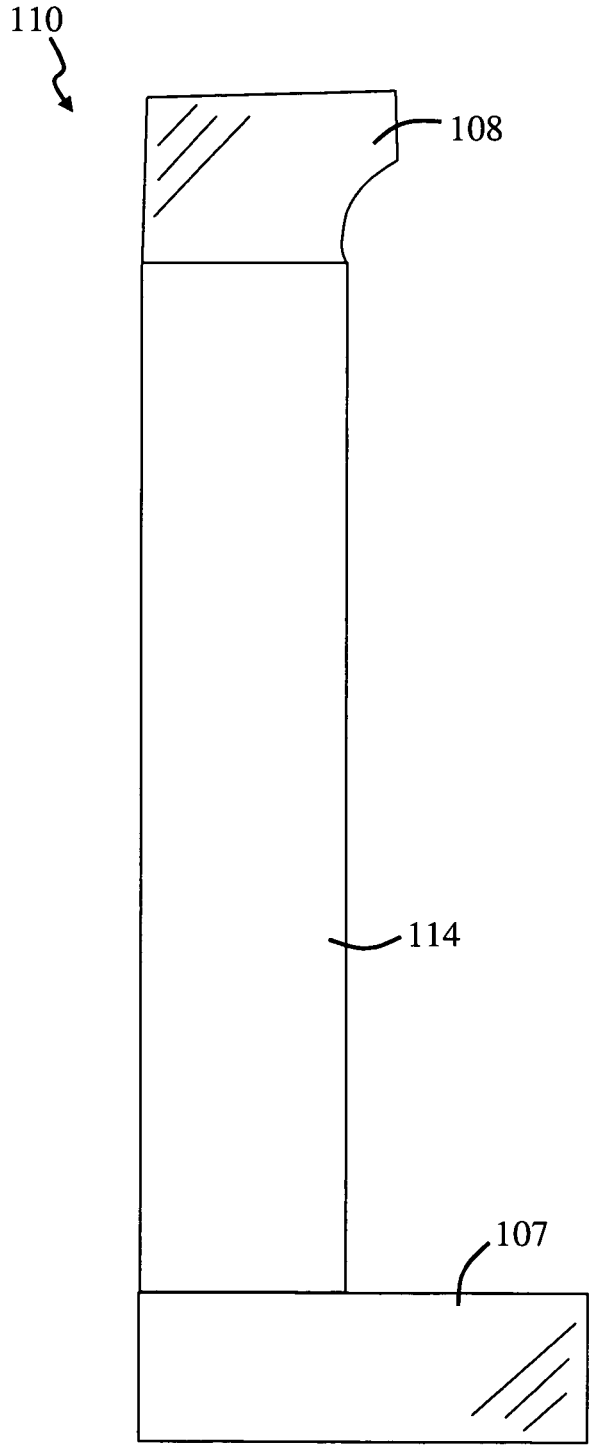
FIG. 3*c* is a side view of the frame of FIG. 1*c* with a crown and shelf.

FIG. 3*c* is a side view of frame 110 with a crown 108 and shelf 107, wherein crown 108 is coupled with upper frame member 112 and shelf 107 is coupled with lower frame member 111. Crown 108 is repeatably moveable between positions engaged with and disengaged from upper frame member 112. Hence, a user can include crown 108 with frame 110, if desired, and the user can remove crown 108 and replace it with another crown. In this way, the user can control the look of frame 110. Shelf 107 is repeatably moveable between positions engaged with and disengaged from lower frame member 111. Hence, the user can include shelf 107 with frame 110, if desired, and the user an remove shelf 107 and replace it with another shelf. Shelf 107 is useful so that personal items, such as toiletries, can be carried by it.

FIG. 4*a* is a perspective view of medicine cabinet 100 in an open condition, wherein medicine cabinet 100 carries an organizer 130, in accordance with the invention. Organizer 130 is used to hold one or more personal items and can be carried by medicine cabinet 100 in many different ways. In this embodiment, organizer 130 is carried by door 102 so that organizer 130 moves in response to the movement of door 102. Organizer 130 is positioned so that it is between cabinet body 101 and door 102 when door 102 is closed. Organizer 130 can be carried by door 102 in many different ways. For example, an adhesive can be used to adhesively couple organizer 130 and door 102 together. Organizer 130 can also be coupled to door 102 with frame 110. As discussed in more detail with FIGS. 4*d*, 4*e*, 4*f* and 4*g*, organizer 130 can be coupled to door 102 with a dowel.

In this embodiment, organizer 130 includes a strap 132 which extends over the upper portion of door 102. Further, organizer 130 includes straps 131 which extend downwardly from strap 132 and along back surface 106 of door 102. Organizer 130 includes one or more pockets for holding the personal items. The pockets of organizer 130 allow more personal items to be stored with medicine cabinet 100. Further, the pockets of organizer 130 allow for the personal items to be organized as desired by the user. It should be noted that, in some embodiments, organizer 130 includes a strap 132*a* which extends over the lower portion of door 102, wherein straps 131 extend upwardly from strap 132*a*. Hence, straps 131 extend between straps 132 and 132*a*.

In this embodiment, the pockets are positioned at different locations along strap 131 so that the pockets are spaced apart from each other along back surface 106. In particular, organizer 130 includes a pocket 133*a* positioned at a distal end of strap 131, and pockets 133*b*, 133*c*, 133*d*, and 133*e* positioned along strap 131 between pocket 133*a* and strap 100. In this way, organizer 130 includes a number of pockets positioned along the length of strap 131. It should be noted that the pockets included with organizer 130 can be the same size or different sizes. For example, in this embodiment, pocket 133*a* is larger than pockets 133*b*, 133*c*, 133*d* and 133*a*. In some embodiments, straps 131 and pockets 133*a*-133*e* include hook and loop tape to allow the pockets to be positioned as desired along straps 133. Further, the hook and loop tape allows the pockets to be interchanged and replaced with different sized pockets. In this way, the number of pockets included with organizer 130, as well as their positioning, can be adjusted by the user so that the personal items can be organized as desired. Hence, the pockets are adjustable to adjust their position on the strap.

Medicine cabinet 100 includes a number of shelves, denoted as shelves 140*a*, 140*b*, 140*c* and 140*d*. Shelves 140*a*-140*d* are spaced apart from each other to form compartments between them. In this embodiment, a compartment 142*a* is between shelves 140*a* and 140*b*, a compartment 142*b* is between shelves 140*b* and 140*c*, a compartment 142*c* is between shelves 140*c* and 140*d* and a compartment 142*d* is above shelf 140*d*. It should be noted that the compartments of medicine cabinet 100 can receive one or more pockets of organizer 130. For example, in this embodiment, compartment 142*a* receives three pockets and compartments 142*b*, 142*c* and 142*d* each receive two pockets.

Shelves 140*a*-140*d* are spaced apart from each other so that the pockets of organizer 130 can be positioned between them when door 102 is closed. Further, shelves 140*a*-140*d* are spaced apart from each other so that the pockets of organizer 130 can be positioned within the compartments when door 102 is closed. In particular, pockets 133*a* and 133*b* are positioned within compartment 142*a*, pocket 133*c* is positioned within compartment 142*b*, pocket 133*d* is positioned within compartment 142*c* and pocket 133*e* is positioned within compartment 142*d* when door 102 is closed. When straps 131 and pockets 133*a*-133*e* include hook and loop tape, pockets 131*a*-133*e* can be positioned as desired along straps 131 so that they are positioned within corresponding compartments 142*a*-142*d* when door 102 is closed. Further, pockets 133*a*-133*e* can be moved vertically relative to door 102 and straps 131 in response to the arrangement of shelves 140*a*-140*d*.

Figure 4C:
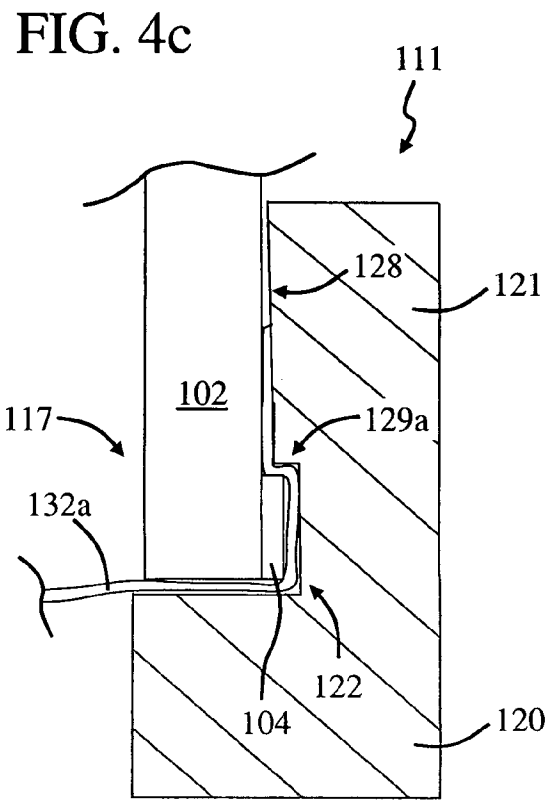
FIG. 4*c* is a side view, taken along a cut-line 4*c*-4*c* of FIG. 4*a*, wherein the organizer is coupled with a lower frame member of the frame of FIG. 1*c*, in accordance with the invention.
Figure 4B:
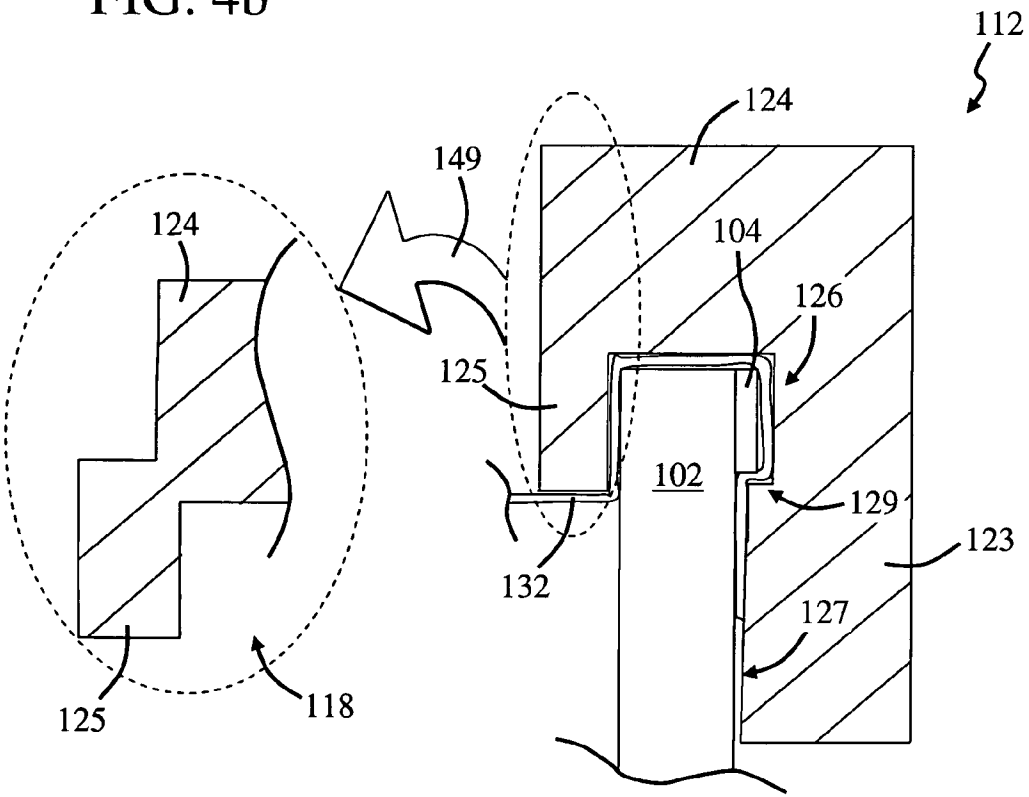
FIG. 4*b* is a side view, taken along a cut-line 4*b*-4*b* of FIG. 4*a*, wherein the organizer is coupled with an upper frame member of the frame of FIG. 1*c*, in accordance with the invention.

FIG. 4*b* is a side view of strap 132 and upper frame member 112, taken along a cut-line 4*b*-4*b* of FIG. 4*a*, wherein strap 132 extends over the upper portion of door 102. In accordance with the invention, upper frame member 112 couples strap 132 to door 102. In particular, strap 132 is frictionally engaged by upper frame member 112 and door 102 and held therebetween. Hence, upper frame member 112 and door 102 cooperate together to hold strap 132. In this way, organizer 130 is coupled to door 102 with frame 110.

In this embodiment, strap 132 extends through upper recess 118 and between door 102 and upper frame member 112. In particular, strap 132 extends through upper recess 118 and between door 102 and upper frame member overhang 125, upper frame member body 124 and downwardly extending portion 123. Further, strap 132 extends through upper recess 118 and between door trim 104 and downwardly extending portion 123. Strap 132 also extends through upper recess 118 and upper door trim recess 126 and between recess overhang 129 and downwardly extending portion 123. Strap 132 is frictionally engaged by and held therebetween door 102 and upper frame member overhang 125, upper frame member body 124 and downwardly extending portion 123. Further, strap 132 is frictionally engaged by and held therebetween door trim 104 and downwardly extending portion 123. It should be noted that, in some embodiments, upper frame member overhang 125 can be offset from upper frame member body 124, as indicated by an indication arrow 149. Upper frame member overhang 125 is offset from upper frame member body 124 so that upper recess 118 is increased in size and can accommodate a thicker door 102.

FIG. 4*c* is a side view of strap 132*a* and lower frame member 111, taken along a cut-line 4*c*-4*c* of FIG. 4*a*, wherein strap 132*a* extends over the lower portion of door 102. In accordance with the invention, lower frame member 111 couples strap 132*a* to door 102. In particular, strap 132*a* is frictionally engaged by lower frame member 111 and door 102 and held therebetween. Hence, lower frame member 111 and door 102 cooperate together to hold strap 132*a*. In this way, organizer 130 is coupled to door 102 with frame 110. It should be noted that strap 132*a* is optional and that organizer 130 can be coupled to door 102 by using strap 132, as described above with FIG. 4*b*.

In this embodiment, strap 132*a* extends through lower recess 117 and between door 102 and lower frame member 111. In particular, strap 132*a* extends through lower recess 117 and between door 102 and lower frame member body 120. Further, strap 132*a* extends through lower recess 117 and lower door trim recess 122 and between door trim 104 and upwardly extending portion 121. Strap 132*a* is frictionally engaged by and held therebetween door 102 and lower frame member body 120 and upwardly extending portion 121. Further, strap 132 is frictionally engaged by and held therebetween door trim 104 and upwardly extending portion 121. In this way, organizer 130 is held between upper and lower frame members 112 and 111. It should be noted that organizer 130 can be stretched between upper and lower frame members 112 and 111 by coupling straps 132 and 132*a* between frame members 112 and 111, respectively.

As mentioned above, frame 110 can be carried by medicine cabinet 100 by using an adhesive to adhesively couple them together. Further, as mentioned above, an adhesive can be used to adhesively couple organizer 130 and door 102 together. The adhesives can be positioned at many different locations to adhesively coupled door 102 to frame 110 and organizer 130. For example, the adhesive can be positioned on engagement surfaces 127 and 128, as well as other locations proximate to upper and lower recesses 118 and 117.

Figure 4E:
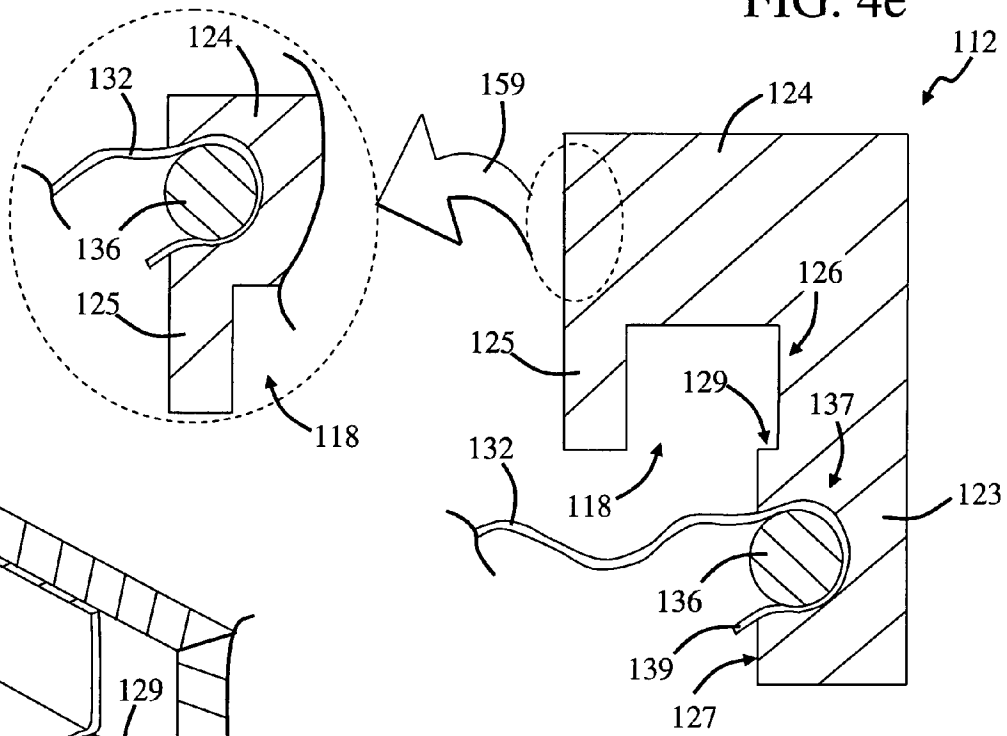
FIGS. 4*e* and 4*f* are side views of the organizer of FIG. 4*a*, taken along cut-line 4*b*-4*b* of FIG. 4*a*, wherein the organizer is coupled with the upper frame member of the frame of FIG. 1*c* with a dowel, in accordance with the invention.
Figure 4D:
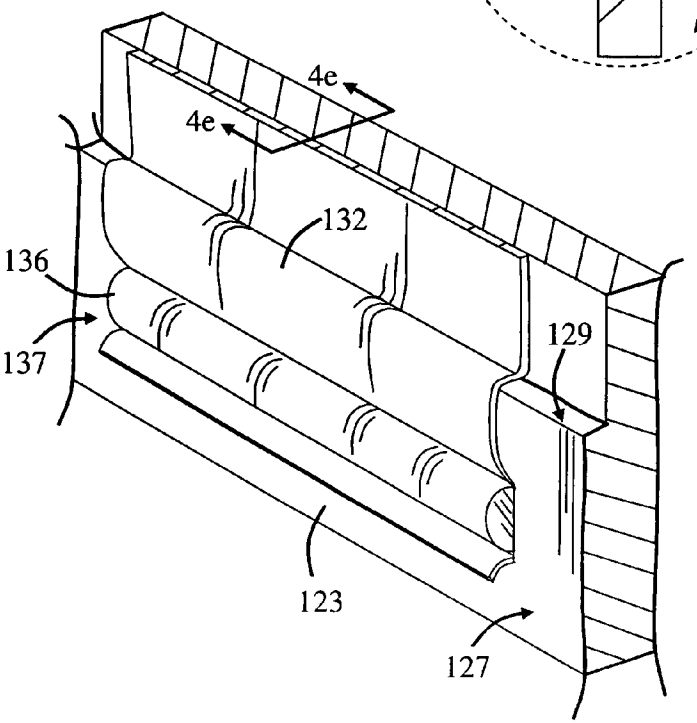
FIG. 4*d* is a perspective view of the organizer of FIG. 4*a* coupled with the upper frame member of the frame of FIG. 1*c* with a dowel, in accordance with the invention.
Figures 4F, 4G:
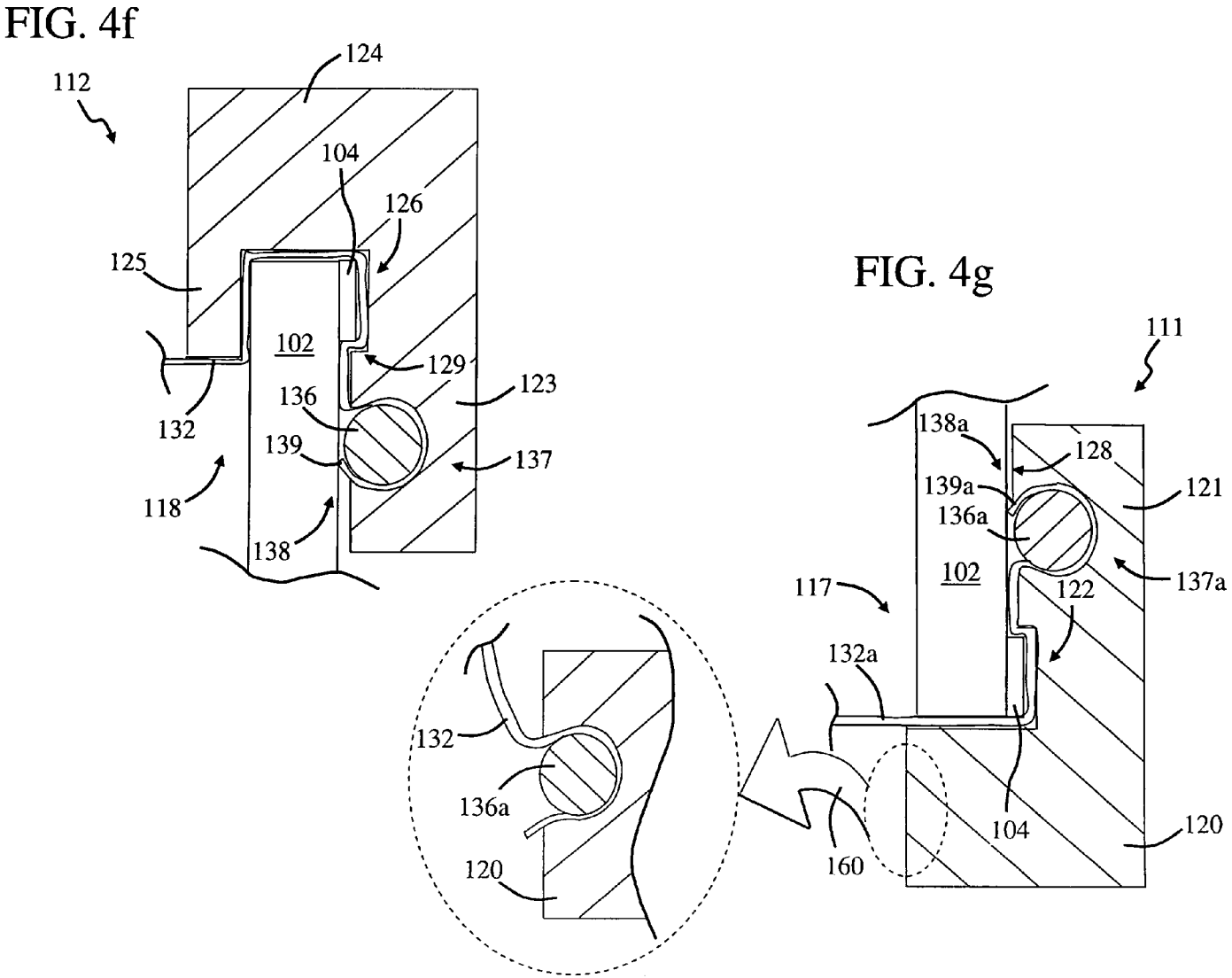
FIG. 4*g* is a side view of the organizer of FIG. 4*a*, taken along a cut-line 4*c*-4*c* of FIG. 4*a*, wherein the organizer is coupled with the lower frame member of the frame of FIG. 1*c* with a dowel, in accordance with the invention.

FIG. 4*d* is a perspective view of strap 132 coupled with upper frame member 112 using a dowel 136, in accordance with the invention. FIGS. 4*e* and 4*f* are side views of strap 132 and upper frame member 112, taken along a cut-line 4*e*-4*e* of FIG. 4*d*. In this embodiment, a dowel recess 137 extends through engagement surface 127 of upper frame member 112, wherein dowel recess 137 is sized and shaped to receive dowel 136 and a portion of strap 132. In particular, dowel recess 137 extends through downwardly extending portion 123 so that dowel 136 holds strap 132 to downwardly extending portion 123. It should be noted that dowel recess 137 can be positioned at other locations of upper frame member 112. For example, dowel recess 137 can extend through upper frame member body 124 and upper frame member overhang 125, if desired, as indicated by an indication arrow 159.

Dowel 136 is held in dowel recess 137 by door 102, as shown in FIG. 4*d*. In this embodiment, door 102 engages strap 132 and moves it through upper recess 118. Strap 132 extends through upper recess 118 and engages recess overhang 129. Further, door 102 holds strap 132 to engagement surface 127 between dowel recess 137 and recess overhang 129. Strap 132 extends between door 102 and downwardly extending portion 123, upper frame member body 124 and upper frame member overhang 125, as described in more detail above with FIG. 4*b*. Door 102 also moves a distal end 139 of strap 132 around dowel 136, as indicated by an indication arrow 138. Hence, upper frame member 112 and door 102 and dowel 136 cooperate together to hold strap 132. In this way, organizer 130 is coupled to door 102 with frame 110 by using a dowel.

FIG. 4*g* is a side view of strap 132*a* coupled with lower frame member 111 using a dowel 136*a*, in accordance with the invention. The side view of FIG. 4*g* is taken along cut-line 4*c*-4*c* of FIG. 4*a*. In this embodiment, a dowel recess 137*a* extends through engagement surface 128 of lower frame member 111, wherein dowel recess 137*a* is sized and shaped to receive dowel 136*a* and a portion of strap 132*a*. In particular, dowel recess 137*a* extends through upwardly extending portion 121 so that dowel 136*a* holds strap 132*a* to upwardly extending portion 121. It should be noted that dowel recess 137*a* can be positioned at other locations of lower frame member 111. For example, dowel recess 137*a* can extend through lower frame member body 120, if desired, as indicated by an indication arrow 160.

Dowel 136*a* is held in dowel recess 137*a* by door 102. In this embodiment, door 102 engages strap 132*a* and moves it through lower recess 117. Strap 132*a* extends through lower recess 117 and engages lower frame member body 120 and upwardly extending portion 121, as described in more detail above with FIG. 4*c*. Further, door 102 holds strap 132*a* to engagement surface 128 between dowel recess 137*a* and lower door trim recess 122 and recess overhang 129*a*. Door 102 also moves a distal end 139*a* of strap 132*a* around dowel 136*a*, as indicated by an indication arrow 138*a*. Hence, lower frame member 111 and door 102 and dowel 136*a* cooperate together to hold strap 132*a*. In this way, organizer 130 is coupled to door 102 with frame 110 by using a dowel. It should be noted that organizer 130 can be stretched between upper and lower frame members 112 and 111 by coupling straps 132 and 132*a* between dowels 136 and 136*a*, respectively.

Figure 5B:
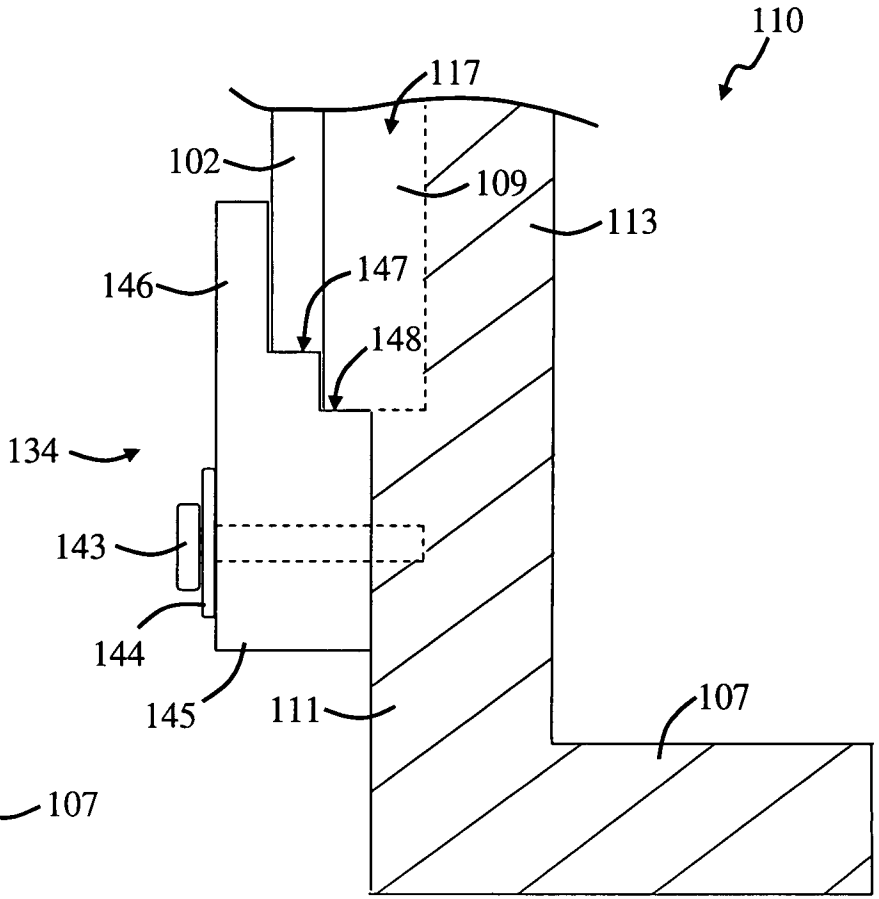
FIG. 5*b* is a close-up view, taken along a cut-line 5*a*-5*a* of FIG. 1*c*, of another latch holding a display piece and the door of the medicine cabinet of FIG. 1*a* to the frame of FIG. 1*c*, in accordance with the invention.
Figure 5A:
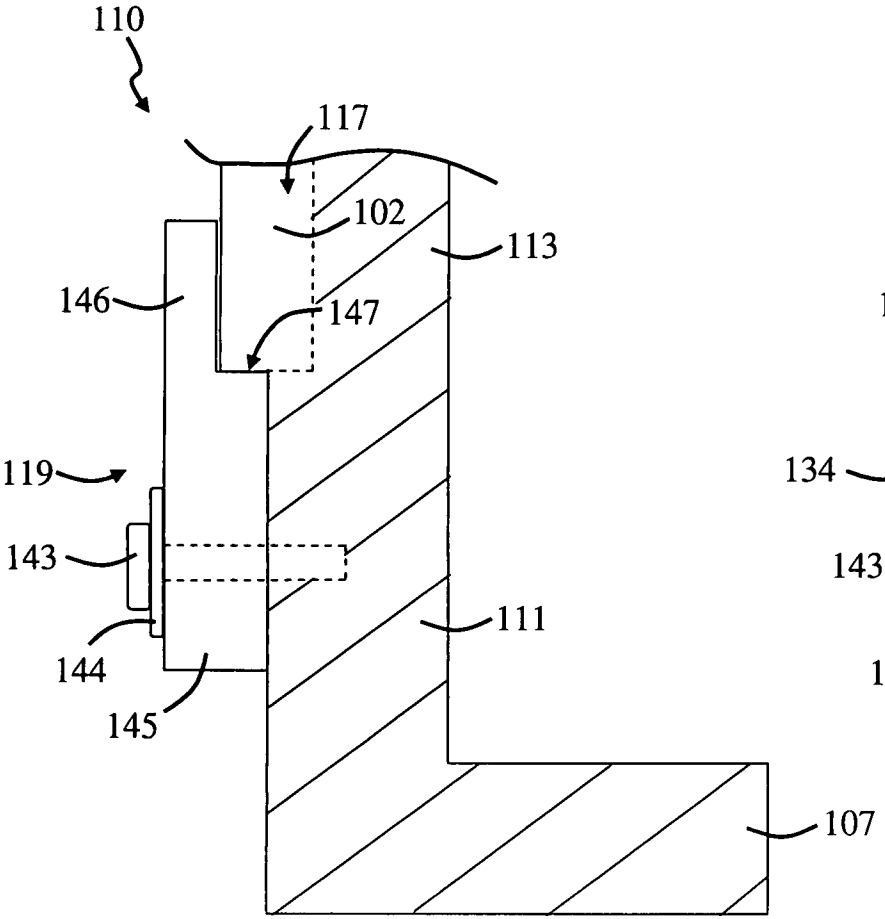
FIG. 5*a* is a close-up view, taken along a cut-line 5*a*-5*a* of FIG. 1*c*, of a latch holding the door of the medicine cabinet of FIG. 1*a* to the frame of FIG. 1*c*, in accordance with the invention.

FIG. 5*a* is a close-up view of latch 119 holding door 102 to frame 110, in accordance with the invention. In this embodiment, latch 119 is coupled with lower frame member 111.

Latch 119 is coupled to lower frame member 111 with a fastener 143 and washer 144, wherein fastener 143 can be of many different types, such as a screw and bolt.

In this embodiment, latch 119 includes a latch body 145 and an outwardly extending arm 146. Further, latch 119 includes a door support surface 147 which extends along latch body 145 proximate to outwardly extending arm 146. Door support surface 147 engages the lower portion of door 102 when door 102 extends through lower recess 117. In this way, door 102 engages outwardly extending arm 146 and latch body 145 of latch 119 and is held to frame 110. Latch 119 is repeatably moveable between positions towards and away from lower recess 117. Latch 119 is repeatably moveable between positions towards and away from lower recess 117 by rotating it about fastener 143. Latch 119 is positioned towards lower recess 117 in the latched position when it is desired to hold frame 110 to door 102. Further, latch 119 is positioned away from lower recess 117 in the unlatched position when it is desired to remove frame 110 from door 102.

FIG. 5*b* is a close-up view of a latch 134 holding display piece 109 and door 102 to frame 110, in accordance with the invention. In this embodiment, latch 134 is coupled with lower frame member 111, wherein latch 134 can replace latches 119*a*, 119*b* and 119*c*. Latch 134 is coupled to lower frame member 111 with fastener 143 and washer 144, as described above.

In this embodiment, latch 134 includes latch body 145 and outwardly extending arm 146. Further, latch 134 includes door support surface 147 and a display piece support surface 148, which extend along latch body 145 proximate to outwardly extending arm 146. Support surfaces 147 and 148 are staggered so that door support surface 147 is further away from body portion 145 than display piece support surface 148. Door support surface 147 engages the lower portion of door 102 when door 102 extends through lower recess 117. In this way, door 102 engages arm portion 146 and body portion 145 of latch 119 and is held to frame 110. Display piece support surface 148 engages the lower portion of display piece 109 when display piece 109 extends through lower recess 117, wherein display piece 109 is positioned adjacent to door 102.

Latch 134 is repeatably moveable between positions towards and away from lower recess 117. Latch 134 is positioned towards lower recess 117 in the latched position when it is desired to hold frame 110 and display piece 109 to door 102. Further, latch 134 is positioned away from lower recess 117 in the unlatched position when it is desired to remove frame 110 and/or display piece 109 from door 102. Latch 134 is repeatably moveable between positions towards and away from lower recess 117 by rotating it about fastener 143.

Figure 5C:
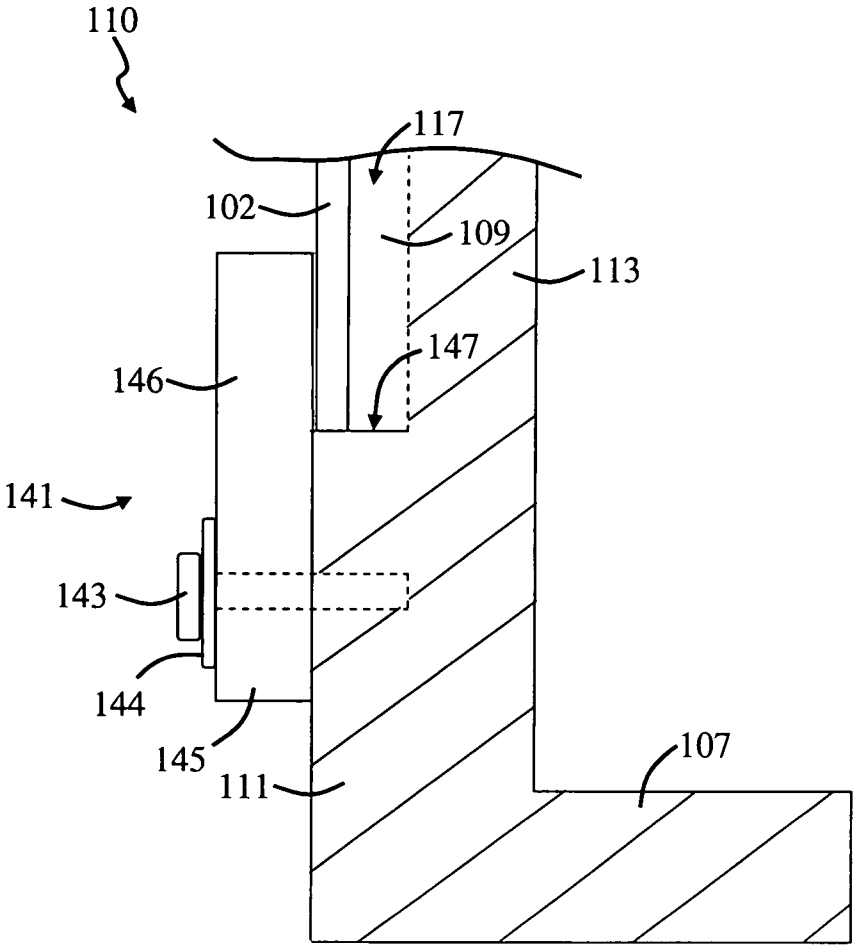
FIG. 5*c* is a close-up view, taken along a cut-line 5*a*-5*a* of FIG. 1*c*, of another latch holding a display piece and the door of the medicine cabinet of FIG. 1*a* to the frame of FIG. 1*c*, in accordance with the invention.

FIG. 5*c* is a close-up view of a latch 141 holding display piece 109 and door 102 to frame 110, in accordance with the invention. In this embodiment, latch 141 is coupled with lower frame member 111, wherein latch 141 can replace latches 119*a*, 119*b* and 119*c*. Latch 141 is coupled to lower frame member 111 with fastener 143 and washer 144, as described above.

In this embodiment, latch 141 includes latch body 145 and outwardly extending arm 146. Further, latch 141 does not include a door support surface or a display piece support surface 148. Instead, display piece 109 and door 102 extend through lower recess 117, wherein door 102 engages arm portion 146 and is held to frame 110.

Latch 141 is repeatably moveable between positions towards and away from lower recess 117. Latch 141 is positioned towards lower recess 117 in the latched position when it is desired to hold frame 110 and display piece 109 to door 102. Further, latch 141 is positioned away from lower recess 117 in the unlatched position when it is desired to remove frame 110 and/or display piece 109 from door 102. Latch 141 is repeatably moveable between positions towards and away from lower recess 117 by rotating it about fastener 143. It should be noted that display piece 109 and frame 110 can be held to door 102 in many other ways, one of which will be discussed in more detail presently.

Figure 6B:
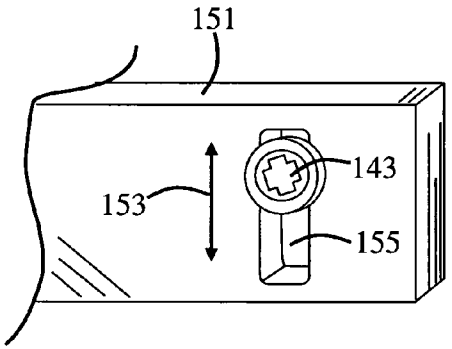
FIGS. 6*b* and 6*c* are close-up perspective and side views, respectively, of the guide rail of FIG. 6*a*.
Figure 6A:
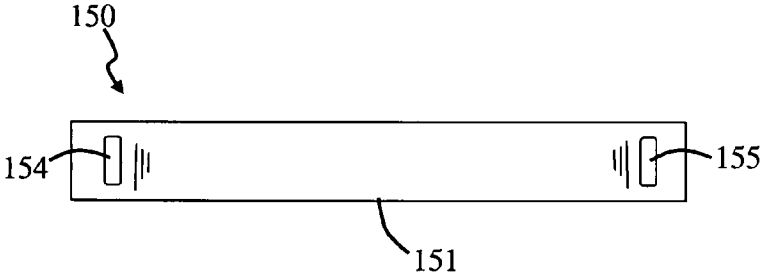
FIG. 6*a* is a front view of a guide rail, in accordance with the invention.
Figure 6C:
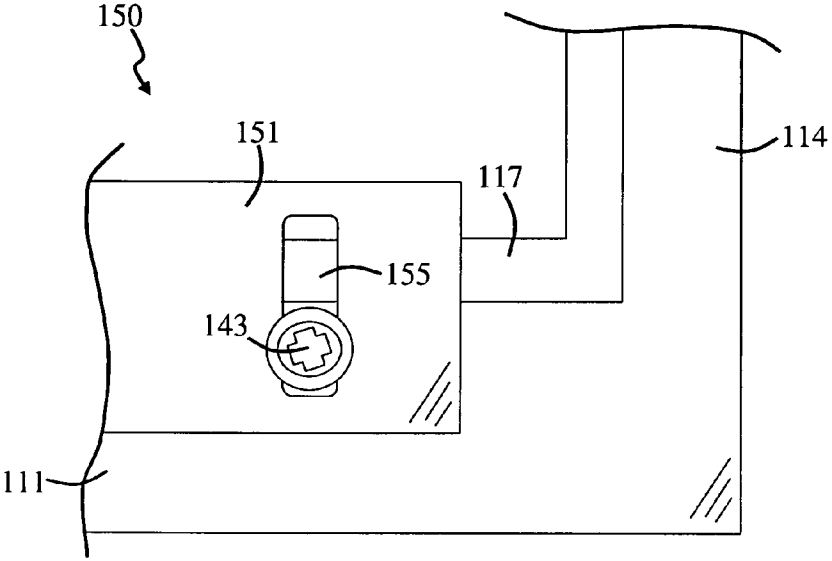

FIG. 6*a* is a front view of a guide rail 150, in accordance with the invention, which can be used to hold frame 110 and display piece 109 to door 102. FIGS. 6*b* and 6*c* are close-up perspective and side views, respectively, of guide rail 150. In this embodiment, guide rail 150 includes a guide rail body 150 through which slots 154 and 155 extend, wherein slots 154 and 155 are spaced apart from each other. Guide rail 150 is positioned adjacent to lower frame member 111 and coupled thereto with fasteners extending through slots 154 and 155 and into lower frame member 111. Guide rail 150 is repeatably moveable between up and down positions, wherein guide rail 150 engages and disengages back surface 106 of door 102 when in the up and down positions, respectively. Frame 110 and display piece 109 can be removed from door 102 when guide rail 150 is in the down position. Guide rail 150 is repeatably moveable between the up and down positions by moving it relative to the fasteners which extend through slots 154 and 155. For example, as shown in FIG. 6*b*, fastener 143 can move through slot 155 as indicated by a direction arrow 153. Fastener 143 is tightened to hold rail 150 in place and fastener 143 is loosened when it is desired to move guide rail 150 relative to it.

In this embodiment, slot 155 is oblong and extends vertically so that guide rail 150 can move vertically relative to lower frame member 111. Slot 155 is oblong and extends vertically so that guide rail 150 can move along vertical frame members 113 and 114. Guide rail 150 moves vertically relative to lower frame member 111 when fastener 143 moves through the vertical slot portion of slot 155.

Figure 7B:
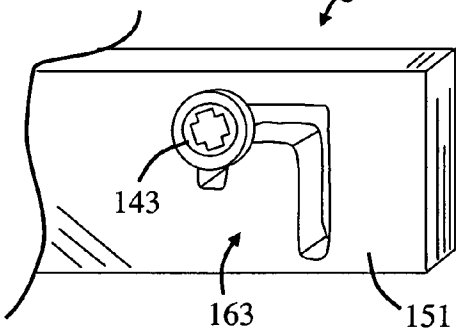
FIGS. 7*b* and 7*c* are close-up perspective and side views, respectively, of the guide rail of FIG. 7*a*.
Figure 7A:
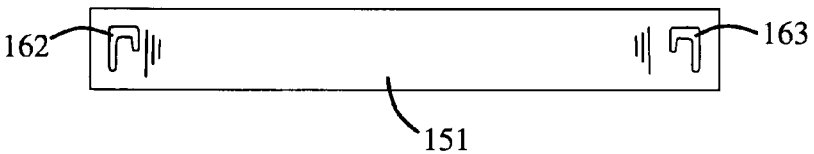
FIG. 7*a* is a front view of another guide rail, in accordance with the invention.
Figure 7C:
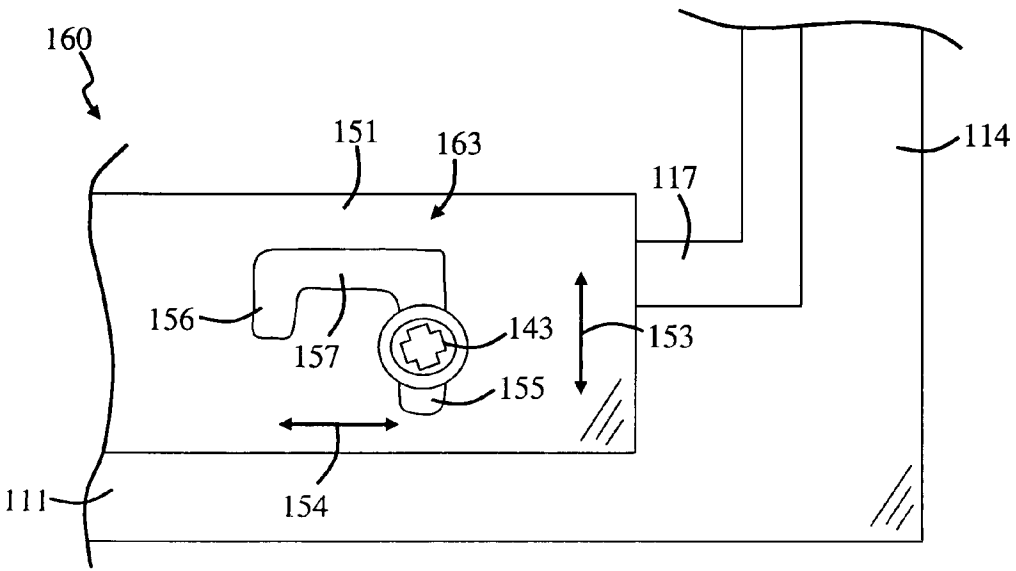

FIG. 7*a* is a front view of a guide rail 160, in accordance with the invention, which can be used to hold frame 110 and display piece 109 to door 102. FIGS. 7*b* and 7*c* are close-up perspective and side views, respectively, of guide rail 160. In this embodiment, guide rail 160 includes guide rail body 150 through which slots 162 and 163 extend, wherein slots 162 and 163 are spaced apart from each other. Guide rail 160 is positioned adjacent to lower frame member 111 and coupled thereto with fasteners extending through slots 162 and 163 and into lower frame member 111. Guide rail 160 is repeatably moveable between up and down positions, wherein guide rail 160 engages and disengages back surface 106 of door 102 when in the up and down positions, respectively. Frame 110 can be removed from door 102 when guide rail 160 is in the down position. Guide rail 160 is repeatably moveable between the up and down positions by moving it relative to the fasteners which extend through slots 162 and 163. For example, as shown in FIG. 6*b*, fastener 143 can move through slot 163 as indicated by direction arrows 153 and 154. Fastener 143 is tightened to hold rail 160 in place and fastener 143 loosened when it is desired to move guide rail 160 relative to it.

In this embodiment, slot 163 includes a horizontal slot portion 157 and vertical slot portions 155 and 156 extending downwardly therefrom and spaced apart from each other. Fastener 143 can be moved through vertical slot portions 155 and 156, as well as horizontal slot portion 157. In this way, guide rail 160 can move horizontally and vertically relative to lower frame member 111. Guide rail 160 moves horizontally relative to lower frame member 111 when fastener 143 moves through horizontal slot portion 157. Guide rail 160 moves vertically relative to lower frame member 111 when fastener 143 moved through vertical slot portions 155 and 156. In this embodiment, vertical slot portion 155 extends further away from horizontal slot portion 157 than vertical slot portion 156.

Figure 8B:
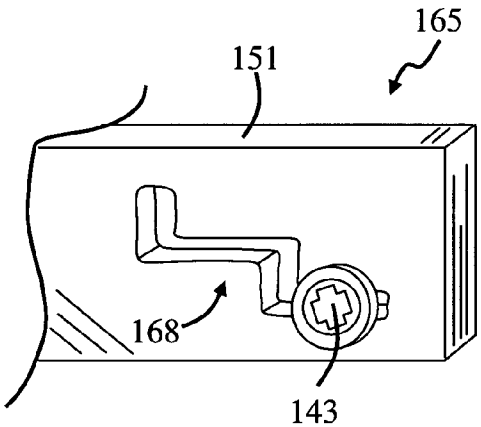
FIGS. 8*b* and 8*c* are close-up perspective and side views, respectively, of the guide rail of FIG. 8*a*.
Figure 8A:
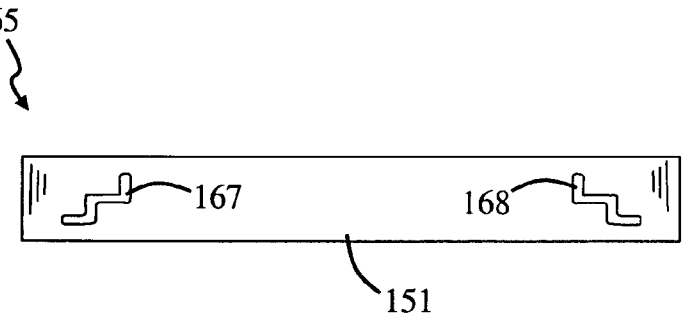
FIG. 8*a* is a front view of another guide rail, in accordance with the invention.
Figure 8C:
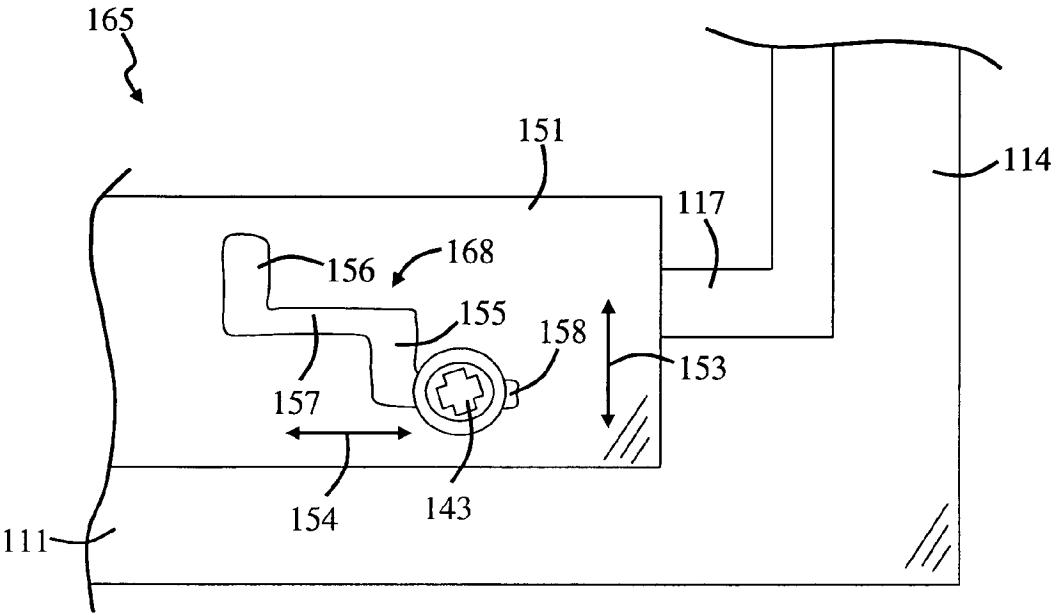

FIG. 8*a* is a front view of a guide rail 165, in accordance with the invention. FIGS. 8*b* and 8*c* are close-up perspective and side views, respectively, of guide rail 165. In this embodiment, guide rail 165 includes guide rail body 150 through which slots 167 and 168 extend, wherein slots 167 and 168 are spaced apart from each other. Guide rail 165 is positioned adjacent to lower frame member 111 and coupled thereto with fasteners extending through slots 167 and 168 and into lower frame member 111. Guide rail 165 is repeatably moveable between up and down positions, wherein guide rail 165 engages back surface 106 of door 102 when in the up position. Frame 110 can be removed from door 102 when guide rail 165 is in the down position. Guide rail 165 is repeatably moveable between the up and down positions by moving it relative to the fasteners which extend through slots 167 and 168. For example, as shown in FIG. 6*b*, fastener 143 can move through slot 168 as indicated by direction arrows 153 and 154. Fastener 143 is tightened to hold guide rail 165 in place and fastener 143 loosened when it is desired to move guide rail 165 relative to it.

In this embodiment, slot 168 includes horizontal slot portions 157 and 158, and vertical slot portions 155 and 156. Vertical slot portion 156 extends upwardly from horizontal slot portion 157 and vertical slot portion 155 extends downwardly from horizontal slot portion 157. Further, horizontal slot portion 158 extends outwardly from vertical slot portion 155, wherein horizontal slot portion 158 is positioned lower than horizontal slot portion 157.

In this way, guide rail 165 can move horizontally and vertically relative to lower frame member 111, as indicated by direction arrows 153 and 154. Guide rail 165 moves horizontally relative to lower frame member 111 when fastener 143 moves through horizontal slot portions 157 and 158. Guide rail 165 moves vertically relative to lower frame member 111 when fastener 143 moves through vertical slot portions 155 and 156.

Figure 9A:
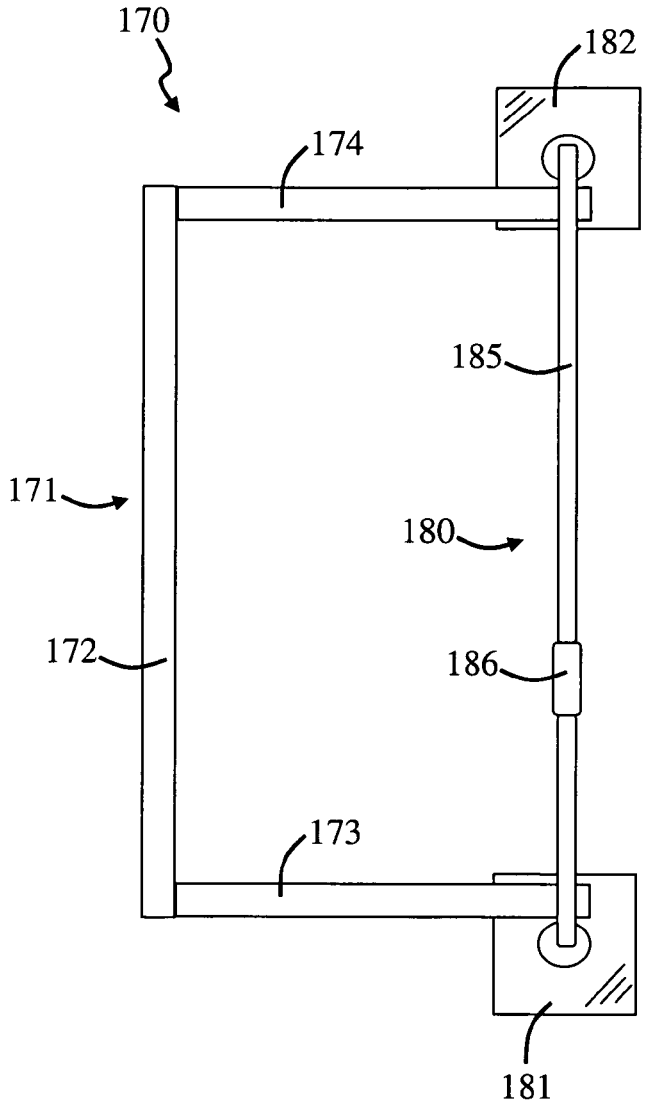
FIG. 9*a* is a front view of a frame assembly, in accordance with the invention, which includes a c-frame and a wall-to-wall panel assembly.

FIG. 9*a* is a front view of a frame assembly 170, in accordance with the invention, which includes a c-frame 171 and a wall-to-wall panel assembly 180. Wall-to-wall panel assemblies are provided by many different manufacturers, such as MOBILE CABLE SYSTEMS of Chicago, Ill. In this embodiment, c-frame 171 includes a vertical frame member 172 and upper and lower horizontal frame members 174 and 173 spaced apart from each other. Upper and lower frame members 174 and 173 extend along the upper and lower portions, respectively, of medicine cabinet 100.

Further, vertical frame member 172 extends along a left side portion of medicine cabinet 100, and wall-to-wall panel assembly 180 extends along a right side portion of medicine cabinet 100. Wall-to-wall panel assembly 180 engages distal ends of upper and lower horizontal frame members 174 and 173 and holds c-frame 171 to medicine cabinet 100.

Figure 9B:
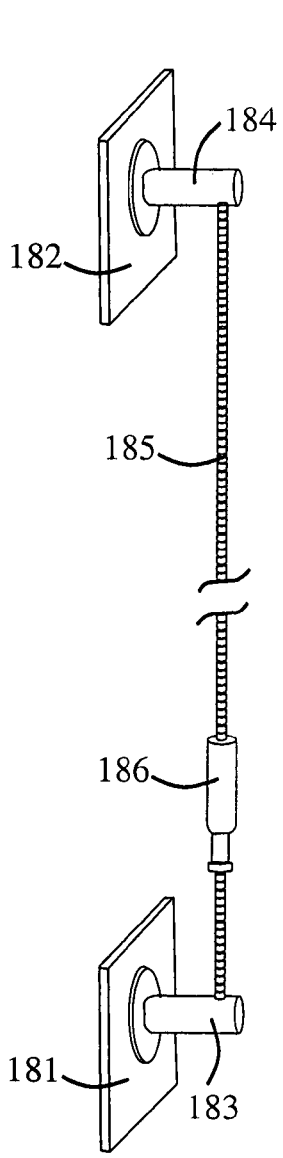
FIG. 9*b* is a close-up perspective view of the wall-to-wall panel assembly of FIG. 9*a*.

FIG. 9*b* is a close-up perspective view of wall-to-wall panel assembly 180. In this embodiment, wall-to-wall panel assembly 180 includes upper and lower base plates 182 and 181 and upper and lower outwardly extending brackets 184 and 183. Upper and lower outwardly extending brackets 184 and 183 extend outwardly from upper and lower base plates 182 and 181, respectively. Wall-to-wall panel assembly 180 includes a cable 185 which extends between upper and lower outwardly extending brackets 184 and 183. Wall-to-wall panel assembly 180 includes a turnbuckle assembly 186 coupled with cable 185, wherein turnbuckle assembly 186 controls the tension of cable 185. Upper outwardly extending bracket 184 extends over upper horizontal frame member 174 and lower outwardly extending bracket 183 extends below lower horizontal frame member 173. Further, cable 185 extends over upper and lower horizontal frame members 174 and 173 so that cable 185 engages them with a larger force when turnbuckle assembly 186 tightens cable 185. Further, cable 185 engages upper and lower horizontal frame members 174 and 173 with a smaller force when turnbuckle assembly 186 loosens cable 185. It should be noted that there is generally a certain amount of play associated with upper and lower outwardly extending brackets 184 and 183 so that brackets 184 and 183 move in response to turnbuckle assembly 186 adjusting the tension in cable 185.

Figure 9C:
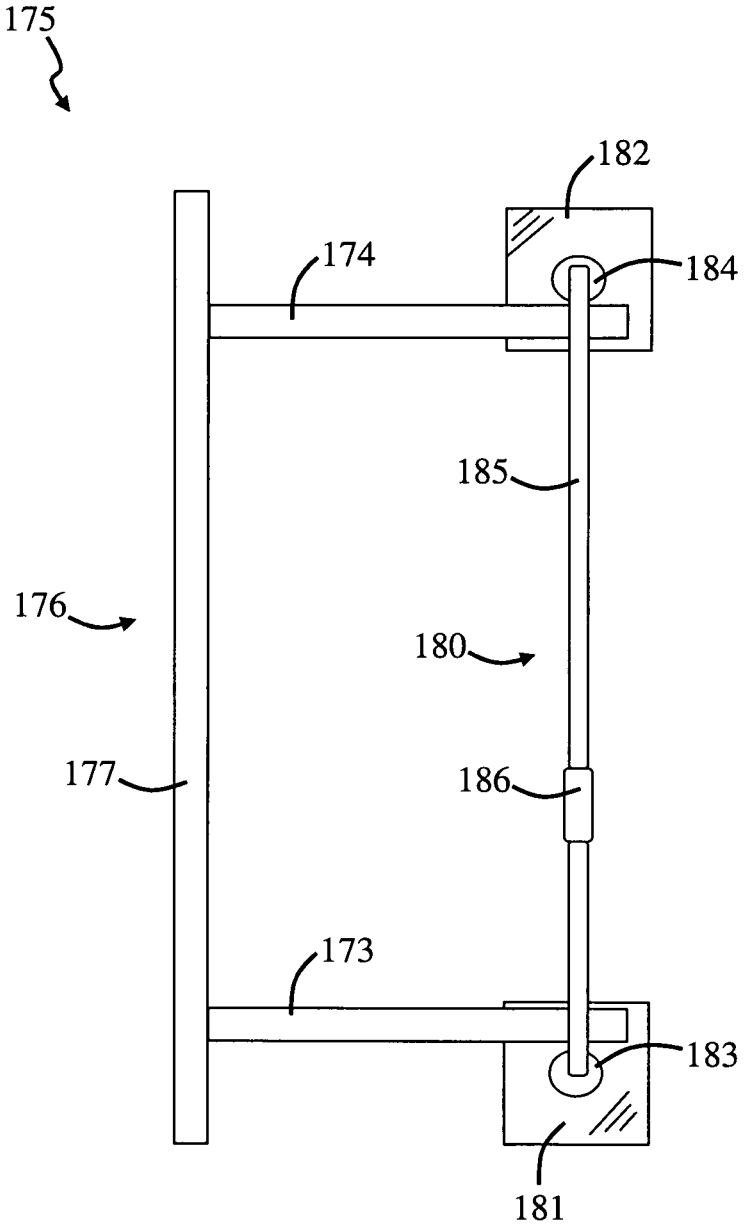
FIG. 9*c* is a front view of another frame assembly, in accordance with the invention, which includes another c-frame and the wall-to-wall panel assembly of FIG. 9*a*.

FIG. 9*c* is a front view of a frame assembly 175, in accordance with the invention, which includes a c-frame 176 and wall-to-wall panel assembly 180. In this embodiment, c-frame 176 includes a vertical frame member 177 and upper and lower horizontal frame members 174 and 175, wherein vertical frame member 177 extends above and below upper and lower horizontal frame members 174 and 173, respectively.

Figure 9D:
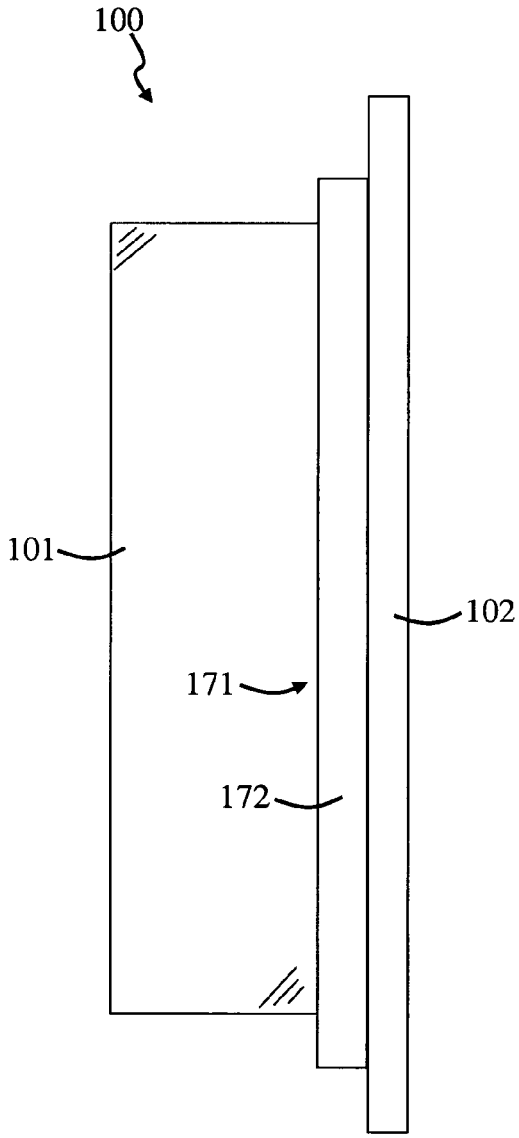
FIGS. 9*d* and 9*e* are side views of the frame assemblies of FIGS. 9*a* and 9*b*, respectively, carried by the medicine cabinet of FIG. 1*a*.
Figure 9E:
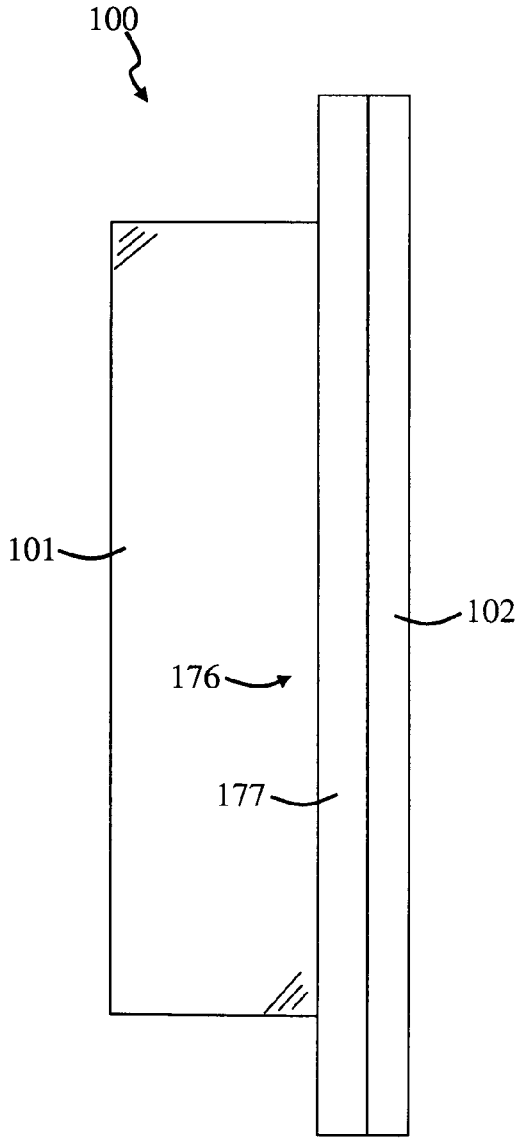

FIGS. 9*d* and 9*e* are side views of frame assemblies 170 and 175, respectively carried by medicine cabinet 100. In this embodiment, vertical frame members 171 and 176 extend along door 102. However, vertical frame member 171 terminates before the upper and lower edges of door 102 and vertical frame member 176 terminates at the upper and lower edges of door 102. In this way, vertical frame member 176 appears to be flush with door 102 when medicine cabinet 100 is viewed from its left side. It should be noted that edge banding tape can be used in combination with the c-brackets, or in place of the c-brackets, if desired.

Figure 9F:
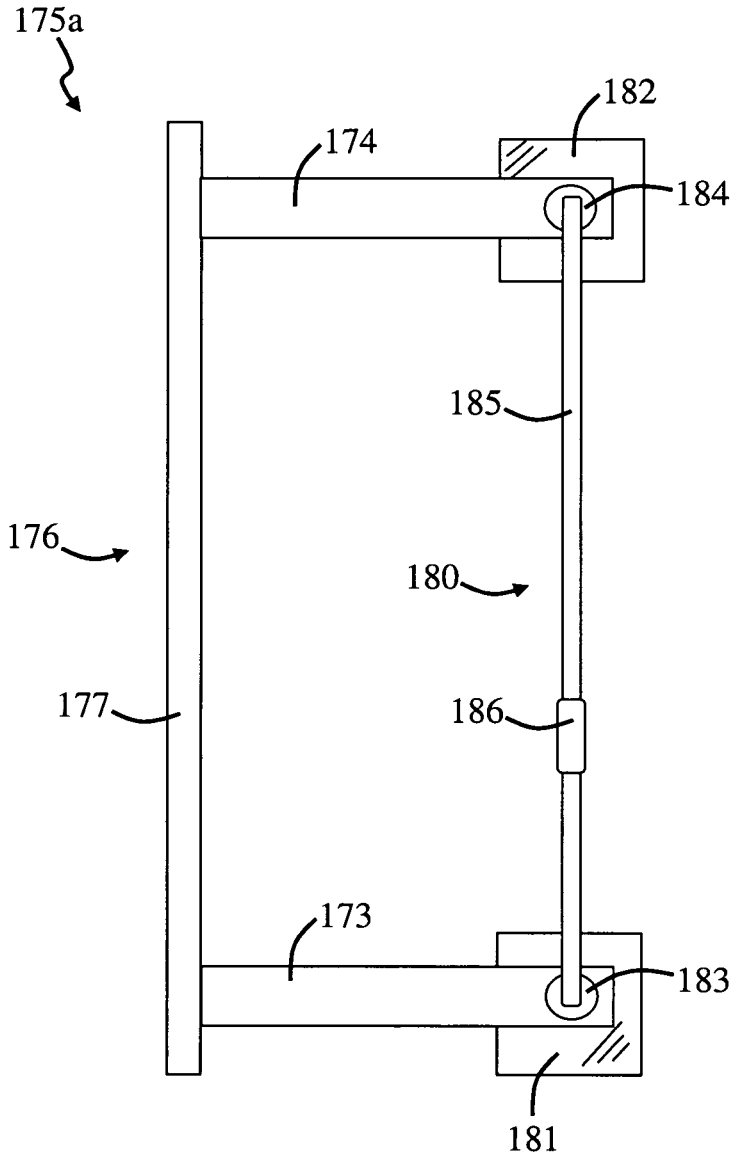
FIG. 9*f* is a front view of another embodiment of a frame assembly, in accordance with the invention.

FIG. 9*f* is a front view of a frame assembly 175*a*, in accordance with the invention, which is similar to frame assembly 175. In this embodiment, lower and upper outwardly extending bracket 183 and 184 extend through lower and upper horizontal frame members 173 and 174, respectively. In this embodiment, lower and upper outwardly extending bracket 183 and 184 extend through lower and upper horizontal frame members 173 and 174, respectively, so that distal ends of lower and upper horizontal frame members 173 and 174 move towards each other in response to adjusting turnbuckle assembly 186.

As mentioned above, turnbuckle assembly 186 controls the tension of cable 185. The distal ends of lower and upper horizontal frame members 173 and 174 move towards each other in response to increasing the tension of cable 185 with turnbuckle assembly 186. Lower and upper fame members 173 and 174 grasp medicine cabinet 100 more in response to their distal ends moving towards each other. Further, the distal ends of lower and upper horizontal frame members 173 and 174 move away from each other in response to decreasing the tension of cable 185 with turnbuckle assembly 186. As mentioned above, there is generally a certain amount of play associated with upper and lower outwardly extending brackets 184 and 183 so that brackets 184 and 183 move in response to turnbuckle assembly 186 adjusting the tension in cable 185. This play allows brackets 184 and 183 to bias the distal ends of lower and upper frame members 173 and 174 towards and away from each other, as described above.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A fixture, comprising:

a medicine cabinet, which includes a cabinet body, and a door coupled to the cabinet body with a hinge, wherein the hinge directly connects the cabinet body and the door;

a frame having a frame body that forms a recess sized and shaped to receive the door, the door extending through the recess such that the frame is attached to the door;

a door trim recess sized and shaped to receive door trim of the door;

an overhang which engages an upper portion of the door;

an upper frame member which extends along an upper portion of the door; and an organizer which includes a strap which extends between the upper frame member and the door.

2. The fixture of claim 1, further including a latch which is repeatably moveable between positions away from and extending over a lower portion of the door.

3. The fixture of claim 2, wherein the latch includes staggered support surfaces.

4. The fixture of claim 1, wherein the frame further includes a crown repeatably moveable between engaged and disengaged positions with the frame body.

5. The fixture of claim 1, wherein the frame further includes a shelf repeatably moveable between engaged and disengaged positions with the frame body.

6. The fixture of claim 1, further including a guide rail which is repeatably moveable between positions away from and extending over a lower portion of the door.

7. The fixture of claim 1, further including a display piece held to the door by the frame.

8. The fixture of claim 1, wherein the frame includes frame members which bound a frame opening.

9. The fixture of claim 1, wherein the upper frame member has an upper frame member overhang.

10. The fixture of claim 9, wherein the upper frame member overhang engages a back surface of the door when the door is received by the recess.

11. A fixture, comprising:

a medicine cabinet, which includes a cabinet body and a door having a mirror, wherein the door is rotatably mounted to the cabinet body with a hinge, the hinge directly connecting the door and the cabinet body;

a frame having a frame body that forms a recess sized and shaped to receive the door, the door extending through the recess such that the frame is attached to the door;

a door trim recess sized and shaped to receive door trim of the door;

a guide rail which is repeatably moveable between positions away from and extending over the lower portion of the door;

a lower frame member which extends along a lower portion of the door;

an upper frame member which extends along an upper portion of the door;

an upper frame member overhang which extends along an upper portion of the door; and an organizer which includes a strap which extends between the upper frame member and the door, and the lower frame member and door.

12. The fixture of claim 11, wherein the frame is carried by the door.

13. The fixture of claim 11, wherein the guide rail includes a vertically extending slot portion.

14. The fixture of claim 11, wherein the guide rail includes a horizontally extending slot portion.

15. The fixture of claim 11, wherein the guide rail includes vertically and horizontally extending slot portions.

16. The fixture of claim 11, further including a fastener which extends through the guide rail and frame body.

17. The fixture of claim 11, further including a display piece held to the door by the frame.

18. The fixture of claim 11, wherein the frame body includes frame members which bound a frame opening.

19. The fixture of claim 11, further including a vertical rail extending outwardly from the frame body.

20. A fixture, comprising:

a medicine cabinet, which includes a cabinet body, and a door rotatably mounted m the cabinet body with a hinge, wherein the hinge directly connects the cabinet body and the door;

a frame having a frame body that forms a recess sized and shaped to receive the door, the door extending through the recess such that the frame is attached to the door;

a door trim recess sized and shaped to receive door trim of the door;

an upper frame member which extends along an upper portion of the door;

an overhang which engages an upper portion of the door; and an organizer carried by the door, wherein the organizer includes a strap which extends between the upper frame member and an upper portion of the door.

21. The fixture of claim 20, wherein the organizer is coupled with the frame.

22. The fixture of claim 20, wherein the organizer is positioned between the door and cabinet body when the door is closed.

23. The fixture of claim 20, wherein a portion of the organizer extends through the recess.

24. The fixture of claim 20, wherein a portion of the organizer extends through the recess and between the frame and door.

25. The fixture of claim 20, further including a display piece held to the door by the frame.

26. The fixture of claim 20, wherein the frame includes frame members which bound a frame opening.

27. The fixture of claim 26, wherein the strap extends between the upper frame member and a lower frame member of the frame.

28. The fixture of claim 27, further including a pocket carried by the strap.

29. The fixture of claim 28, wherein the pocket is adjustable to adjust its position on the strap.

* * * * *